US011286715B2

(12) United States Patent
Marzilli

(10) Patent No.: US 11,286,715 B2
(45) Date of Patent: Mar. 29, 2022

(54) ROLLER BLIND ASSEMBLY

(71) Applicant: Antonio Marzilli, Mississauga (CA)

(72) Inventor: Antonio Marzilli, Mississauga (CA)

( * ) Notice: Subject to any disclaimer, the term of this patent is extended or adjusted under 35 U.S.C. 154(b) by 0 days.

(21) Appl. No.: 16/940,923

(22) Filed: Jul. 28, 2020

(65) Prior Publication Data

US 2021/0054692 A1 Feb. 25, 2021

Related U.S. Application Data

(60) Provisional application No. 62/889,345, filed on Aug. 20, 2019.

(51) Int. Cl.

| | |
|---|---|
| ***E06B 9/42*** | (2006.01) |
| ***E06B 9/60*** | (2006.01) |
| ***E06B 9/80*** | (2006.01) |

(52) U.S. Cl.

CPC ..... *E06B 9/42* (2013.01); *E06B 9/60* (2013.01); *E06B 9/80* (2013.01); *E06B 2009/801* (2013.01)

(58) Field of Classification Search

CPC ..... E06B 9/42; E06B 9/50; E06B 9/56; E06B 9/60; E06B 9/62; E06B 9/80; E06B 2009/801; E06B 9/90

See application file for complete search history.

(56) References Cited

U.S. PATENT DOCUMENTS

| | | | | |
|---|---|---|---|---|
| 1,885,400 | A * | 11/1932 | Ygger | E06B 9/88 160/295 |
| 4,429,729 | A * | 2/1984 | Winslow | E06B 9/60 144/193.1 |
| 6,648,050 | B1 * | 11/2003 | Toti | E06B 9/322 160/170 |
| 7,234,503 | B2 * | 6/2007 | Kwak | E06B 9/42 160/295 |
| 9,631,425 | B2 * | 4/2017 | Campagna | E06B 9/60 |
| 10,017,984 | B2 | 7/2018 | Marzilli et al. | |
| 10,364,602 | B2 * | 7/2019 | Kwak | E06B 9/50 |
| 10,753,148 | B2 * | 8/2020 | Jay | E06B 9/88 |
| 2018/0179814 | A1 | 6/2018 | Kwak | |

* cited by examiner

*Primary Examiner* — Beth A Stephan

(74) *Attorney, Agent, or Firm* — Bereskin & Parr LLP/S.E.N.C.R.L., s.r.l.

(57) ABSTRACT

A roller blind assembly includes a blind roller, a clutch assembly that includes a bracket engagement member, and a pre-torsioned spring assembly that includes a spring. The pre-torsioned spring assembly is positioned in an interior cavity of the blind roller, and exerts a torque proportional to a preset torsion of the spring to promote rotation of the blind roller relative to the bracket engagement member. Rotation of the blind roller relative to the bracket engagement member in a first direction decreases torsion in the spring while rotation of the blind roller relative to the bracket engagement member in a second direction increases torsion in the spring. The pre-torsioned spring assembly is preferably selected from a group of at least two pre-torsioned spring assemblies, each spring assembly having a different spring preset torsion.

25 Claims, 16 Drawing Sheets

ROLLER BLIND ASSEMBLY

CROSS-REFERENCE TO RELATED APPLICATIONS

This application claims the benefit of U.S. Provisional Application No. 62/889,345 filed on Aug. 20, 2019, which is incorporated by reference herein in its entirety.

FIELD OF THE INVENTION

This application relates generally to apparatus for supporting blind rollers, and more specifically to roller blind assemblies that include a pre-torsioned spring assembly selected from at least two pre-torsioned spring assemblies.

INTRODUCTION

Roller blinds are well known. Such blinds are commonly used, for example, to selectively control the passage of light through openings (e.g. windows, glass doors, and the like) in residential, commercial, and industrial buildings.

It is known to provide roller blind assemblies with some form of 'spring-assist' in which a spring (or other biasing member) is provided to urge the blind roller towards a raised position in an effort to at least partially offset the weight of blind material hanging from the blind roller.

Spring-assisted roller blind assemblies often require a significant degree of customization during assembly and/or installation. For example, the blind material supported on the rollers can vary in size based on the size of the window or door to be covered. Also, blinds can be made from a variety of materials, including opaque or 'black-out' blinds (that block all or substantially all light), translucent blinds (that allow some light to pass through the blind material), and the like, with each blind fabric possibly having a different weight. As a result, there is significant amount of variance across roller blind assemblies. It is not uncommon for frequent adjustments and/or interchange of parts to be made during the assembly and/or installation of a spring-assisted roller blind to facilitate its operation. These drawbacks are often compounded and can lead to a complex, inefficient, and/or costly installation process.

SUMMARY

The following summary is provided to introduce the reader to the more detailed discussion to follow. The summary is not intended to limit or define any claimed or as yet unclaimed invention. One or more inventions may reside in any combination or sub-combination of the elements or process steps disclosed in any part of this document including its claims and figures.

For typical spring-assisted roller blind systems, a manufacturer and/or assembler of such systems may have a large number of different parts, including: springs of different lengths, thicknesses, and/or materials; blind control mechanisms of different sizes and/or types (e.g. cord-driven, chain-driven); and mounting hardware of different configurations. To construct a roller blind system suitable for a particular application (e.g. based on the width, height, and weight of the blind material to be supported by the blind roller system), the manufacturer and/or assembler may construct and/or maintain—e.g. by trial-and-error—a large grid or matrix of suitable component combinations.

However, the individual components themselves may have significant variability (e.g. for a batch of springs with the same rated performance, individual springs within the batch exhibit actual performance that deviates from the rated performance, e.g. by +/−5%, +/−10%, or more). Accordingly, even if the manufacturer and/or assembler selects appropriate components based on their rated performance, the actual assembled system may not perform as expected. Accordingly, manufacturers and/or assemblers often need to assemble and test each roller blind system (and substitute components as needed if the performance of the assembled system is unacceptable) before sending it out to be installed. This may result in decreased efficiency and/or increased cost.

Also, typical spring-assisted roller blind systems may require relatively fine or precise adjustments to be made during their on-site installation. As a result, if a system is not correctly calibrated during the initial installation, the installer (or another technician) may need to make one or more return visits to the installation site.

As disclosed herein, roller blind assemblies may include a pre-torsioned spring assembly. Providing a pre-torsioned spring assembly for a roller blind assembly may have one or more advantages. For example, a pre-torsioned assembly may reduce or eliminate the need for on-site calibration during installation, as compared with typical spring-assisted roller blind systems.

As another example, by providing pre-torsioned spring assemblies having different preset torsions, a manufacturer and/or assembler may be more confident that an assembly of specified components will have the correct performance, which may minimize or eliminate the need to pre-assemble and/or test the roller blind system prior to sending it out for installation. This may result in increased efficiency and/or decreased cost as compared to known roller blind systems.

In accordance with one broad aspect, there is provided a roller blind assembly comprising: a blind roller comprising a cylindrical wall extending from a first roller end to a second roller end, the wall defining an interior cavity extending from the first roller end; a clutch assembly comprising a bracket engagement member, a shaft coupling member extending from the bracket engagement member, and a blind roll engaging member positioned within the interior cavity of the blind roller to support the blind roller, the clutch assembly being configured to exert a holding torque on the blind roller to inhibit rotation of the blind roller relative to the bracket engagement member; and a pre-torsioned spring assembly comprising: a shaft extending from a first shaft end to a second shaft end, the first shaft end configured to engage the shaft coupling member to couple the shaft to the clutch assembly; and a spring extending around the shaft, the spring having a first spring end coupled proximate to the first shaft end and a second spring end operatively coupled proximate to second shaft end, wherein the spring has a preset torsion; wherein the pre-torsioned spring assembly is positioned in the interior cavity of the blind roller, wherein the pre-torsioned spring assembly exerts a torque on the blind roller proportional to the preset torsion of the spring to assist rotation of the blind roller.

In some embodiments, rotation of the blind roller in a first direction relative to the bracket engagement member decreases a torsion in the spring, thereby decreasing the torque that the pre-torsioned spring assembly exerts on the blind roller.

In some embodiments, the torsion in the spring remains greater than or equal to the preset torsion as the blind roller rotates.

In some embodiments, rotation of the blind roller in a second direction opposite the first direction increases the torsion in the spring, thereby increasing the torque that the pre-torsioned spring assembly exerts on the blind roller.

In some embodiments, the shaft has a threaded section proximate the second shaft end and the pre-torsioned spring assembly further comprises: a restraining member defining a threaded internal passage extending axially therethrough, wherein the threaded section of the shaft is received within the internal passage and threadably engages therewith, wherein the restraining member is configured for movement along the threaded section of the shaft; and a restraining body removably coupled to the restraining member, wherein the restraining body is configured to engage the interior cavity of the blind roller such that the restraining member and the restraining body rotate in unison with the blind roller; wherein the second spring end is coupled to the restraining body, and wherein, when the restraining body is coupled to the restraining member, the restraining body and the restraining member cooperate to maintain the preset torsion.

In some embodiments, the wall of the blind roller has a longitudinally extending groove that projects inwardly into the interior cavity, and the restraining body is configured to engage the groove.

In some embodiments, the restraining body comprises a cap and a sleeve portion removably received within the cap, and the cap is configured to engage the groove of the blind roller.

In some embodiments, the wall of the blind roller has a longitudinally extending groove that projects inwardly into the interior cavity, and the blind roll engaging member is configured to engage the groove.

In some embodiments, the shaft coupling member comprises a rod extending from the bracket engagement member, and a locking head is provided at an end of the rod distal from the bracket engagement member.

In some embodiments, the locking head is positionable in an opening defined in the first shaft end, and the locking head includes at least one radially extending protrusion and the first shaft end includes at least one complementary recess for receiving the at least one protrusion to provide a predetermined alignment of the shaft coupling member with the first shaft end.

In some embodiments, the roller blind assembly further comprises a locking collar positionable around the shaft at the first shaft end when the at least one radially extending protrusion is received in the at least one complementary recess.

In some embodiments, the first shaft end is positionable in an opening defined in the shaft coupling member, and the shaft coupling member includes at least one radially inwardly extending protrusion and the first shaft end includes at least one complementary recess for receiving the at least one protrusion to provide a predetermined alignment of the shaft coupling member with the first shaft end.

In some embodiments, the clutch assembly is configured such that rotation of the blind roller relative to bracket engagement member varies torsion in the spring.

In some embodiments, the bracket engagement member comprises an end plate of the clutch assembly.

In some embodiments, the end plate comprises an integrated cord guard.

In some embodiments, the blind roll engaging member comprises a generally cylindrical body positioned around the shaft coupling member, the body having a generally cylindrical outer surface.

In some embodiments, the restraining member comprises a restraining nut, and the restraining body comprises a restraining nut engagement recess facing towards the second shaft end and a clip that retains the restraining nut in the restraining nut engagement recess.

In accordance with another broad aspect, there is provided a kit for a roller blind assembly, the kit comprising: a blind roller comprising a cylindrical wall extending from a first roller end to a second roller end, the wall defining an interior cavity extending from the first roller end; a clutch assembly comprising a bracket engagement member, a shaft coupling member extending from the bracket engagement member, and a blind roll engaging member positionable within the interior cavity of the blind roller to support the blind roller, the clutch assembly being configured to exert a holding torque on the blind roller to inhibit rotation of the blind roller relative to the bracket engagement member; and a plurality of pre-torsioned spring assemblies, wherein each pre-torsioned spring assembly in the plurality of pre-torsioned spring assemblies comprises: a shaft extending from a first shaft end to a second shaft end, the first shaft end configured to engage the shaft coupling member to couple the shaft to the clutch assembly; and a spring extending around the shaft, the spring having a first spring end coupled proximate to the first shaft end, and a second spring end operatively coupled proximate to the second shaft end, wherein the spring has a preset torsion; wherein a first pre-torsioned spring assembly in the plurality of pre-torsioned spring assemblies has a different spring preset torsion than a second pre-torsioned spring assembly in the plurality of pre-torsioned spring assemblies, wherein a selected one of the plurality of pre-torsioned spring assemblies is positionable in the interior cavity of the blind roller, and wherein, when the selected pre-torsioned spring assembly is positioned in the interior cavity of the blind roller, that pre-torsioned spring assembly exerts a torque on the blind roller proportional to the preset torsion of the spring to assist rotation of the blind roller.

In some embodiments, rotation of the blind roller in a first direction relative to the bracket engagement member decreases a torsion in the spring, thereby decreasing the torque that the pre-torsioned spring assembly exerts on the blind roller.

In some embodiments, the torsion in the spring remains greater than or equal to the preset torsion as the blind roller rotates rotation.

In some embodiments, rotation of the blind roller in a second direction opposite the first direction increases the torsion in the spring, thereby increasing the torque that the pre-torsioned spring assembly exerts on the blind roller.

In some embodiments, the shaft of each pre-torsioned spring assembly in the plurality of pre-torsioned spring assemblies has a threaded section proximate the second shaft end and each pre-torsioned spring assembly in the plurality of pre-torsioned spring assemblies further comprises: a restraining member defining a threaded internal passage extending axially therethrough, wherein the threaded section of the shaft is received within the internal passage and threadably engages therewith, wherein the restraining member is configured for movement along the threaded section of the shaft; and a restraining body removably coupled to the restraining member, wherein the restraining body is configured to engage the interior cavity of the blind roller such that the restraining member and the restraining body rotate in unison with the blind roller; wherein the second spring end is coupled to the restraining body, and wherein, when the restraining body is coupled to the restraining member, the restraining body and the restraining member cooperate to maintain the preset torsion.

In some embodiments, the wall of the blind roller has a longitudinally extending groove that projects inwardly into the interior cavity, and the restraining body is configured to engage the groove.

In some embodiments, the restraining body comprises a cap and a sleeve portion removably received within the cap, and the cap is configured to engage the groove of the blind roller.

In some embodiments, the kit further comprises a plurality of the blind rollers and a plurality of the caps, each of the plurality of blind rollers and caps having a different diameter.

In some embodiments, the wall of the blind roller has a longitudinally extending groove that projects inwardly into the interior cavity, and the blind roll engaging member is configured to engage the groove.

In some embodiments, the shaft coupling member comprises a rod extending from the bracket engagement member, and a locking head is provided at an end of the rod distal from the bracket engagement member.

In some embodiments, the locking head is positionable in an opening defined in the first shaft end, and the locking head has at least one radially extending protrusion and the first shaft end has at least one complementary recess for receiving the at least one protrusion to provide a predetermined alignment of the shaft coupling member with the first shaft end.

In some embodiments, the kit further comprises a locking collar positionable around the shaft at the first shaft end when the at least one radially extending protrusion is received in the at least one complementary recess.

In some embodiments, the first shaft end is positionable in an opening defined in the shaft coupling member, and the shaft coupling member has at least one radially inwardly extending protrusion and the first shaft end has at least one complementary recess for receiving the at least one protrusion to provide a predetermined alignment of the shaft coupling member with the first shaft end.

In some embodiments, the clutch assembly is configured such that rotation of the bracket engagement member relative to the blind roller varies torsion in the spring.

In some embodiments, the bracket engagement member comprises an end plate of the clutch assembly.

In some embodiments, the end plate comprises an integrated cord guard.

In some embodiments, the blind roll engaging member comprises a generally cylindrical body positioned around the shaft coupling member, the body having a generally cylindrical outer surface.

In some embodiments, the restraining member comprises a restraining nut, and the restraining body comprises a restraining nut engagement recess facing the second shaft end and a clip that retains the restraining nut in the restraining nut engagement recess.

In accordance with another broad aspect, this is provided a roller blind assembly securable between a first support bracket and a second support bracket horizontally spaced apart from the first support bracket, the roller blind assembly comprising: support brackets mounted to a wall, the roller blind assembly comprising: I) a blind roller comprising a cylindrical wall extending from a first roller end to a second roller end, the wall defining an interior cavity extending between the first and second roller ends; II) a holding assembly comprising: a) a housing positioned within the interior cavity of the blind roller, wherein the housing extends longitudinally between a first housing end and a second housing end, wherein the housing is configured to engage the interior cavity of the blind roller such that the housing rotates in unison with the blind roller; b) a connector configured to secure the housing, at the first housing end, to the first support bracket, wherein, when the connector is secured to the first support bracket, the housing rotates independently of the connector; and c) at least one spool assembly located within the housing, the at least one spool assembly comprising: a first spool and a second spool rotatably mounted to the housing; and a resilient band extending between a first band end and a second band end, wherein the first band end is secured to the first spool and the second band end is secured to the second spool, wherein wrapping the resilient band around one of the first and second spools concurrently unwraps the resilient band from the other of the first and second spools; wherein, when the connector is secured to the first support bracket, the holding assembly is configured to exert a resisting torque on the blind roller to inhibit rotation of the blind roller relative to the connector; III) a pre-torsioned spring assembly comprising: i) a shaft extending from a first shaft end to a second shaft end, the shaft having a threaded section proximate the second shaft end; ii) a plug configured to secure the first shaft end to the second support bracket, iii) a restraining member defining a threaded internal passage extending axially therethrough, wherein the threaded section of the shaft is received within the internal passage and threadably engages therewith, wherein the restraining member is configured for movement along the threaded section of the shaft; iv) a restraining body removably coupled to the restraining member, wherein the restraining body is configured to engage the interior cavity of the blind roller such that the restraining member and the restraining body rotate in unison with the blind roller; and v) a spring extending around the shaft, the spring having a first spring end coupled to the first shaft end, and a second spring end coupled to the restraining body, wherein the spring has a preset torsion, wherein, when the restraining body is coupled to the restraining member, the restraining body and the restraining member cooperate to maintain the preset torsion; wherein the pre-torsioned spring assembly is positioned in the interior cavity of the blind roller, wherein the pre-torsioned spring assembly exerts a torque on the blind roller proportional to the preset torsion of the spring to assist rotation of the blind roller.

In some embodiments, rotation of the blind roller in a first direction relative to the shaft decreases a torsion in the spring, thereby decreasing the torque that the pre-torsioned spring assembly exerts on the blind roller, and rotation of the blind roller in a second direction relative to the shaft increases the torsion in the spring, thereby increasing the torque that the pre-torsioned spring assembly exerts on the blind roller.

In some embodiments, the torsion in the spring remains greater than or equal to the preset torsion as the blind roller rotates.

In some embodiments, the resisting torque exerted on the blind roller by the holding assembly remains constant as the blind roller rotates.

In some embodiments, the wall of the blind roller has a longitudinally extending groove that projects inwardly into the interior cavity, and the restraining body is configured to engage the groove.

In some embodiments, the restraining body comprises a cap and a sleeve portion removably received within the cap, and the cap is configured to engage the groove of the blind roller.

In some embodiments, the wall of the blind roller has a longitudinally extending groove that projects inwardly into the interior cavity, and the plug is configured to engage the groove.

In some embodiments, the plug comprises a plug body securable to the second support bracket and a generally cylindrical plug collar positioned around the plug body, and the plug collar is configured to engage the groove of the blind roller and, when the plug body is secured to the second support bracket, the plug collar rotates independently of the plug body.

In some embodiments, the plug collar extends from a first end to a second end, wherein a portion of the plug body protrudes from the second end of the plug collar, and the portion comprises a coupling head.

In some embodiments, the coupling head is positionable in an opening defined in the first shaft end, and the coupling head has at least one radially extending protrusion and the first shaft end has at least one complementary recess for receiving the at least one protrusion.

In some embodiments, the roller blind assembly further comprising a locking collar positionable around the shaft at the first shaft end when the at least one radially extending protrusion is received in the at least one complementary recess.

In some embodiments the first shaft end is positionable in an opening defined in the second plug end, and the plug body includes at least one radially inwardly extending protrusion and the first shaft end includes at least one complementary recess for receiving the at least one protrusion.

In some embodiments, the wall of the blind roller has a longitudinally extending groove that projects inwardly into the interior cavity, and the housing is configured to engage the groove.

In some embodiments, the housing is generally cylindrical.

In some embodiments, the restraining member comprises a restraining nut, and the restraining body comprises a restraining nut engagement recess facing the second shaft end and a clip that retains the restraining nut in the restraining nut engagement recess.

In some embodiments, the housing defines a housing rotation axis and, when the connector is secured to the first support bracket, rotation of the housing about the housing rotation axis rotates the first spool about a first spool axis, first spool axis being substantially orthogonal to the housing rotation axis.

In some embodiments, the connector comprises a generally cylindrical connector body extending longitudinally between a first end located at the first housing end and a second end located within the housing; and a connector gear extending from the second end of the connector body.

In some embodiments, the first end of the connector body is substantially flush with the first housing end.

In some embodiments, the holding assembly further comprises a transfer gear rotatably mounted to the housing, the transfer gear engaging the connector gear and, when the connector is secured to the first support bracket, rotation of the housing about the housing rotation axis causes the connector gear to rotate the transfer gear about a transfer gear axis, the transfer gear axis being substantially orthogonal to the housing rotation axis.

In some embodiments, the transfer gear is configured to rotate the first spool of the at least one spool assembly.

In some embodiments, the first spool has a first spool gear located at an end thereof, and the transfer gear engages the first spool gear to drive the first spool gear, thereby rotating the first spool.

In some embodiments, rotation of the first spool in a third direction about the first spool axis wraps the resilient band around the first spool, and wherein rotation of the first spool about the first spool axis in a fourth direction, opposite the third direction, unwraps the resilient band from the first spool.

In some embodiments, the holding assembly comprises two spool assemblies connected in series.

In some embodiments, one of the two spool assemblies is drivingly engaged to the other of the two spool assemblies through at least one intermediate gear.

In some embodiments, the first spool gear of one of the two spool assemblies is drivingly engaged to the first spool gear of the other of the two spool assemblies through three intermediate gears.

In some embodiments, when the connector is secured to the first support bracket, rotation of the housing about the housing rotation axis results in the rotation of the first spool gears of each spool assembly in the same direction.

In some embodiments, the holding assembly further comprises a locking pin actuable between an engaged position and a disengaged position, wherein, in the engaged position, the locking pin inhibits relative rotation between the connector and the housing, and wherein, in the disengaged position, the housing rotates independently of the connector.

In some embodiments, the locking pin is removed from the holding assembly in the disengaged position.

In accordance with another broad aspect, there is provided a kit for a roller blind assembly that is securable between a first support bracket and a second support bracket horizontally spaced apart from the first support bracket, the kit comprising: I) a blind roller comprising a cylindrical wall extending from a first roller end to a second roller end, the wall defining an interior cavity extending from the first roller end; II) a holding assembly comprising: a) a housing positioned within the interior cavity of the blind roller, wherein the housing extends longitudinally between a first housing end and a second housing end, wherein the housing is configured to engage the interior cavity of the blind roller such that the housing rotates in unison with the blind roller; b) a connector configured to secure the housing, at the first housing end, to the first support bracket, wherein, when the connector is secured to the first support bracket, the housing rotates independently of the connector; and c) at least one spool assembly located within the housing, the at least one spool assembly comprising: a first spool and a second spool rotatably mounted to the housing; and a resilient band extending between a first band end and a second band end, wherein the first band end is secured to the first spool and the second band end is secured to the second spool, wherein wrapping the resilient band around one of the first and second spools concurrently unwraps the resilient band from the other of the first and second spools; wherein, when the connector is secured to the first support bracket, the holding assembly is configured to exert a resisting torque on the blind roller to inhibit rotation of the blind roller relative to the connector; III) a plurality of pre-torsioned spring assemblies, wherein each pre-torsioned spring assembly in the plurality of pre-torsioned spring assemblies comprises: i) a shaft extending from a first shaft end to a second shaft end; ii) a plug configured to secure the first shaft end to the second support bracket; and iii) a spring extending around the shaft, the spring having a first spring end coupled proximate to the first shaft end, and a second spring end operatively coupled proximate to the second shaft end, wherein the spring has a preset torsion; wherein a first pre-torsioned spring assembly in the plurality of pre-torsioned spring assemblies has a different spring preset torsion than a second pre-torsioned spring assembly in the plurality of pre-torsioned spring assemblies, wherein a selected one of the plurality of pre-torsioned spring assemblies is positionable in the interior cavity of the blind roller, and wherein, when the selected pre-torsioned spring assembly is positioned in the interior cavity of the blind roller, that pre-torsioned spring assembly exerts a torque on the blind roller proportional to the preset torsion of the spring.

In some embodiments, the shaft of each pre-torsioned spring assembly in the plurality of pre-torsioned spring assemblies has a threaded section proximate the second shaft end, and each pre-torsioned spring assembly in the plurality of pre-torsioned spring assemblies further comprises: a restraining member defining a threaded internal passage extending axially therethrough, wherein the threaded section of the shaft is received within the internal passage and threadably engages therewith, wherein the restraining member is configured for movement along the threaded section of the shaft; and a restraining body removably coupled to the restraining member, wherein the restraining body is configured to engage the interior cavity of the blind roller such that the restraining member and the restraining body rotate in unison with the blind roller; wherein the second spring end is coupled to the restraining body, and wherein, when the restraining body is coupled to the restraining member, the restraining body and the restraining member cooperate to maintain the preset torsion.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
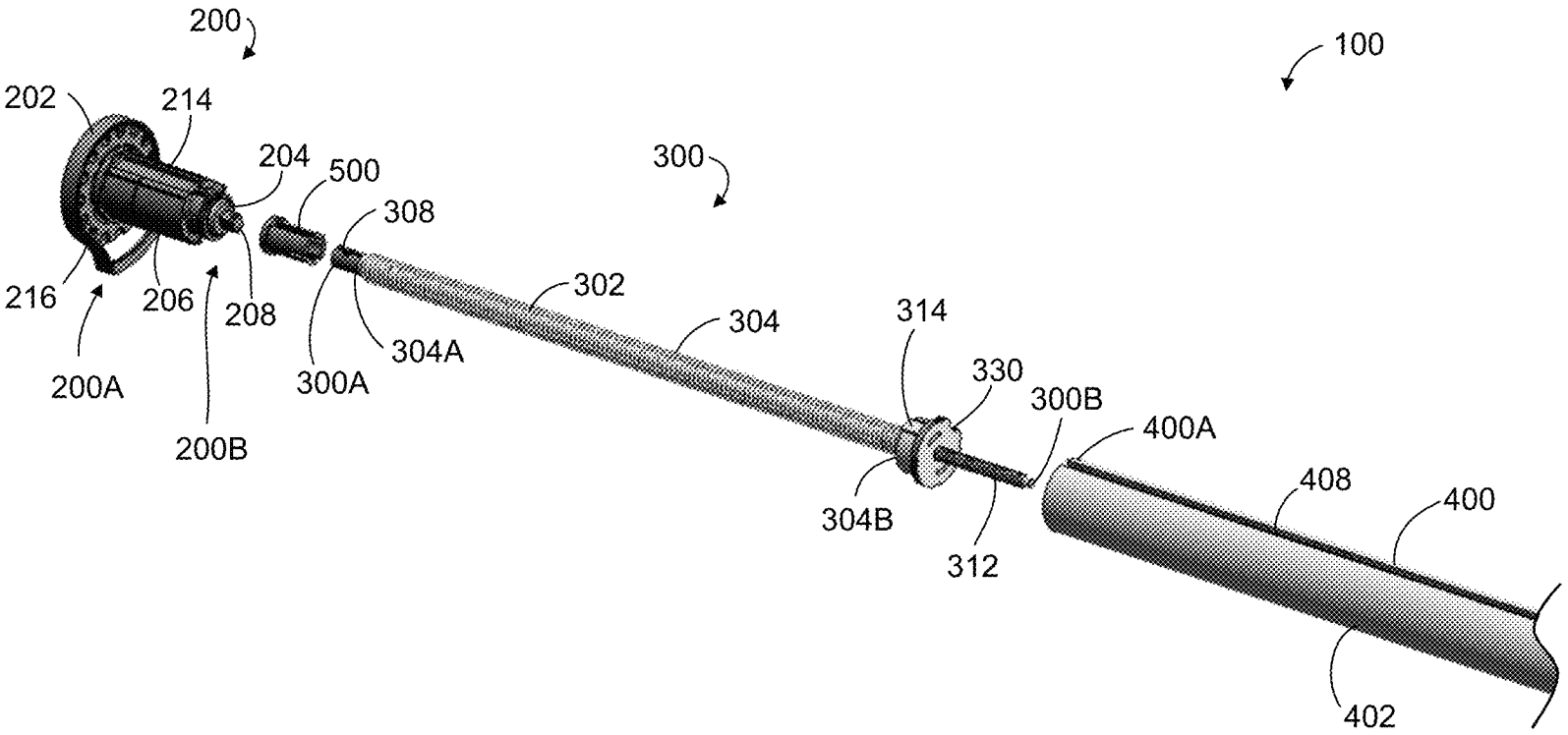
FIG. 1 is an exploded side perspective view of an example roller blind assembly in accordance with an embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

FIGS. 1-11 illustrate an exemplary roller blind assembly, referred to generally as 100, for supporting a blind that selectively covers at least a portion of an opening or a transparent or translucent portion of a building (e.g. a window, glass door, glass wall, and the like). Preferably, roller blind assembly 100 is installed at or above an upper end of a window or door frame. A blind or screen supported by roller blind assembly 100 may be selectively lowered and raised to affect the amount of light passing through the window or door by rotating a blind roller about its longitudinal axis to roll-up (or unroll) the blind material around an outer surface of the blind roller.

A blind may be made from any suitable material or fabric, such as textiles woven from natural and/or synthetic fibers. The size of the unrolled blind (i.e. a length or height in the vertical dimension and a width in the horizontal dimension) may be similarly dimensioned, although larger, than the size of the window frame (or door frame) above which the blind will be hung.

Referring to FIG. 1, roller blind assembly 100 includes a blind roller 400 from which the blind material (not shown) is hung (and around which the blind material is wound when the blind is raised), a clutch assembly 200 for selectively controlling rotation of the blind roller 400 to raise and lower the blind, and a spring assembly 300 for imparting a biasing torque on the blind roller 400 to reduce the external force required to raise the blind.

Blind roller 400 extends from a first roll end 400A to a second roll end (not shown). Blind roller 400 may have any suitable dimensions. Typically, the length of the roller will correspond to the width of the supported blind.

Figure 8:
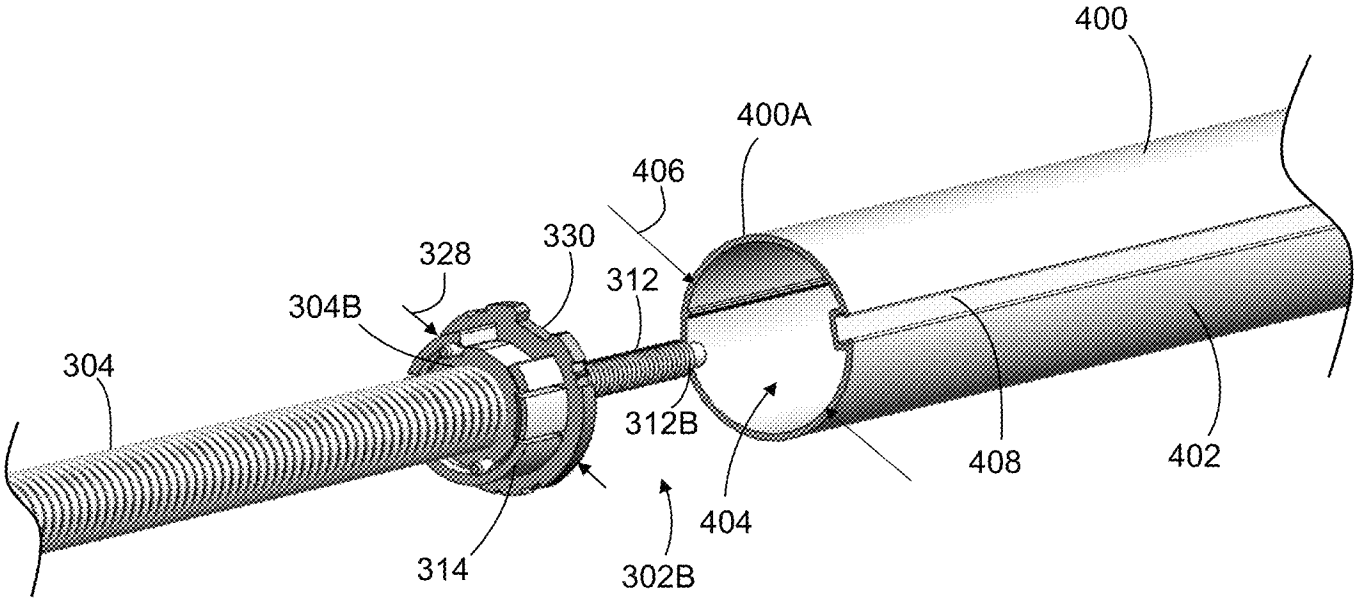
FIG. 8 is a top perspective view of a portion of a pre-torsioned spring device and a roller blind that may be used in the example roll blind assembly of FIG. 1.
Figure 9:
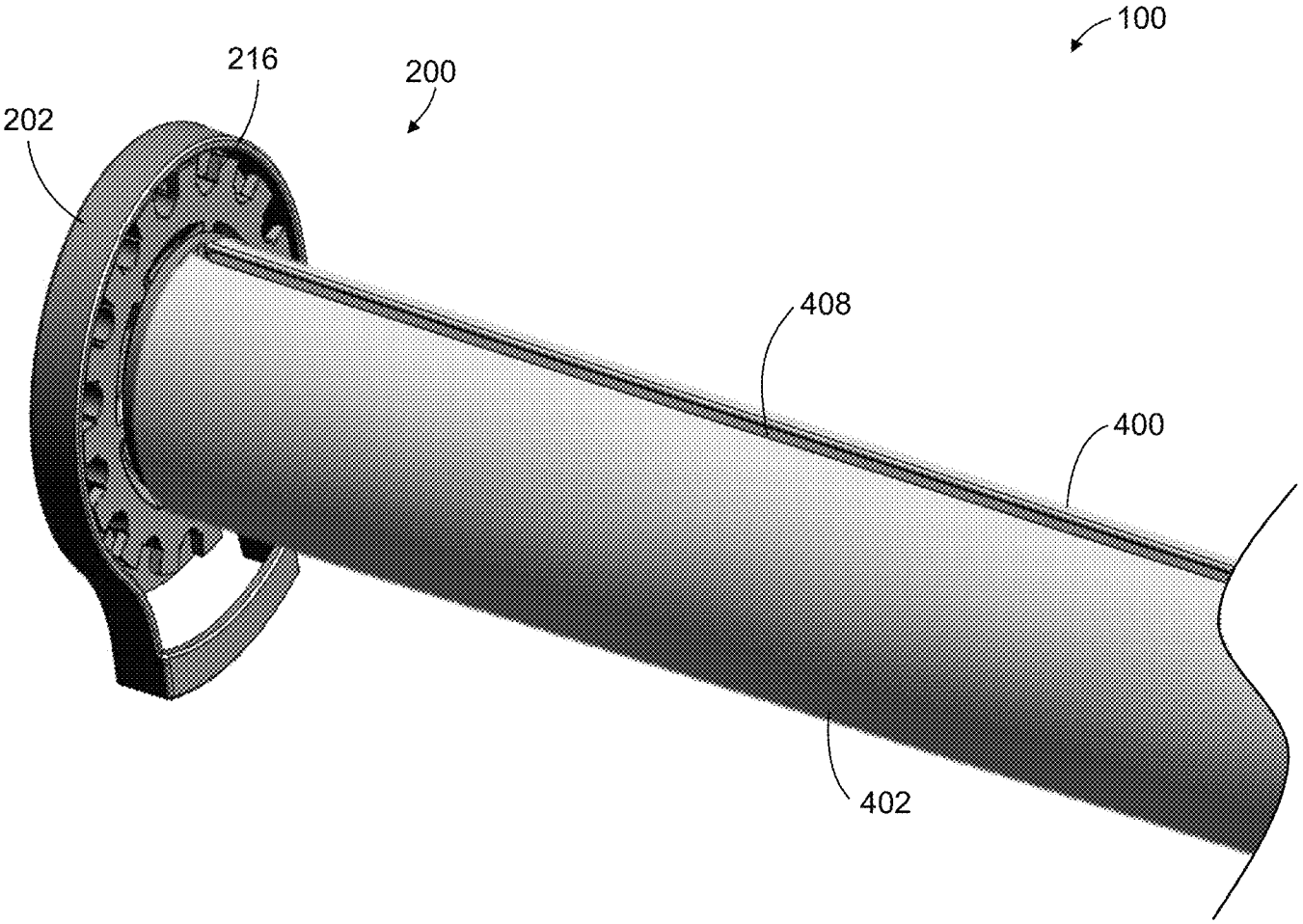
FIG. 9 is a side perspective view of a portion of the example roller blind assembly shown in FIG. 1.

Referring to FIG. 8, the blind roller 400 includes a substantially cylindrical outer wall 402 that extends between the first roll end 400A and the second roll end. Outer wall 402 defines an interior cavity 404 within the blind roller 400. The cylindrical blind roller 400 has an internal diameter 406. Turning to FIG. 9, this allows various components of the roller blind assembly 100 to be positioned within the cavity 404. It will be appreciated that blind roller 400 may be hollow along its entire length in some embodiments.

Referring again to FIG. 1, clutch assembly 200 has a bracket engagement side 200A and a shaft coupling side 200B opposite the bracket engagement side 200A. The spring assembly 300 has a first end 300A and a second end 300B opposite the first end 300A. The first end 300A of spring assembly 300 may be removably coupled with the shaft coupling side 200B of clutch assembly 200. As shown in FIG. 9, when assembled, the spring assembly 300 and a portion of the clutch assembly 200 are positioned within the blind roller 400.

Figure 3:
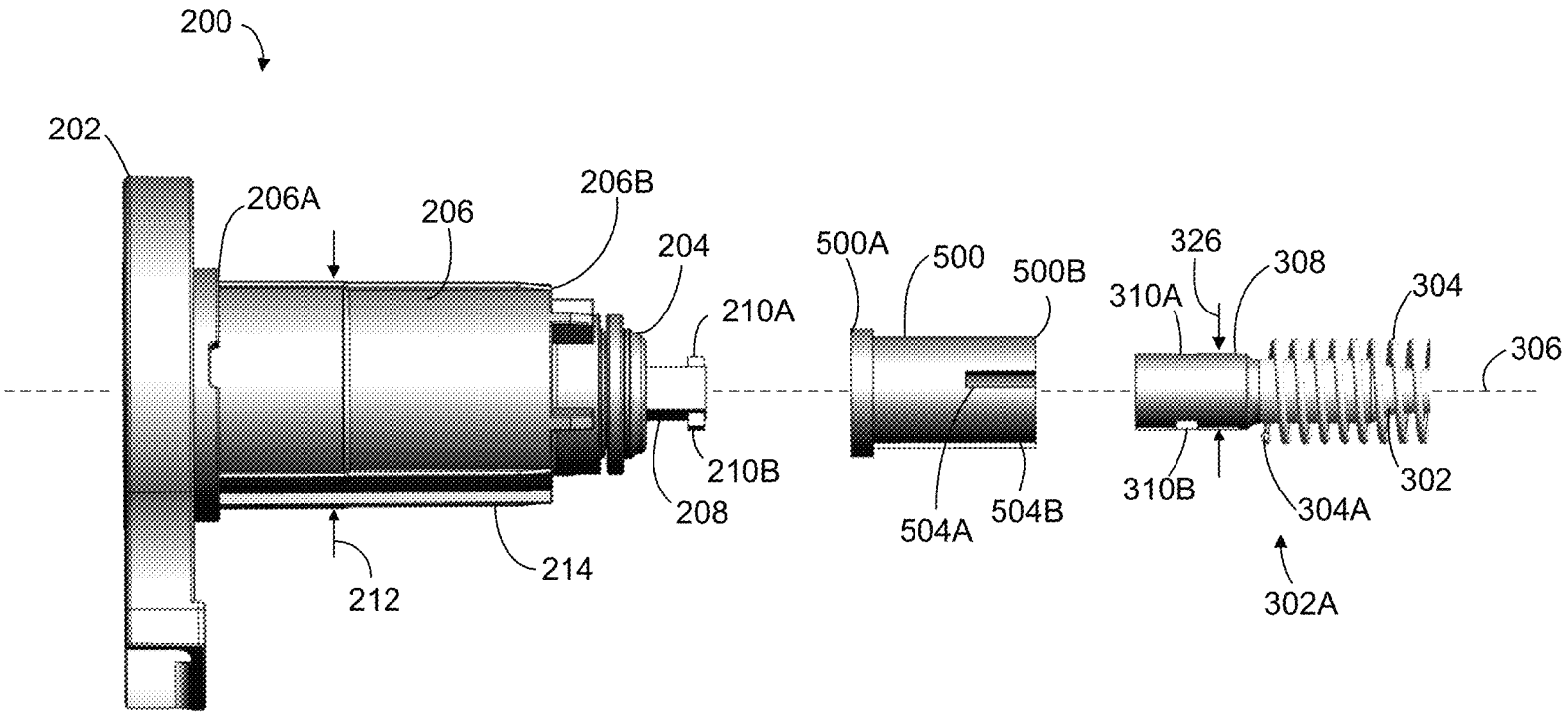
FIG. 3 is an enlarged view of the example roller blind assembly taken at portion 3 of FIG. 2.

With reference to FIGS. 3-6, the clutch assembly 200 includes a bracket engagement member 202, such as end plate 202 (which in the illustrated example includes an integrated cord guide 203), a shaft coupling member 204 (such as rod 204) extending from the bracket engagement member 202, and a blind roll engaging member 206 positioned around the shaft coupling member 204. Referring to FIG. 3, the blind roll engaging member 206 preferably comprises a generally cylindrical body that is positioned around the shaft coupling member 204 over a portion of its length. The bracket engagement 206 member has a generally cylindrical outer surface that extends from a first end 206A to a second end 206B.

Figure 5:
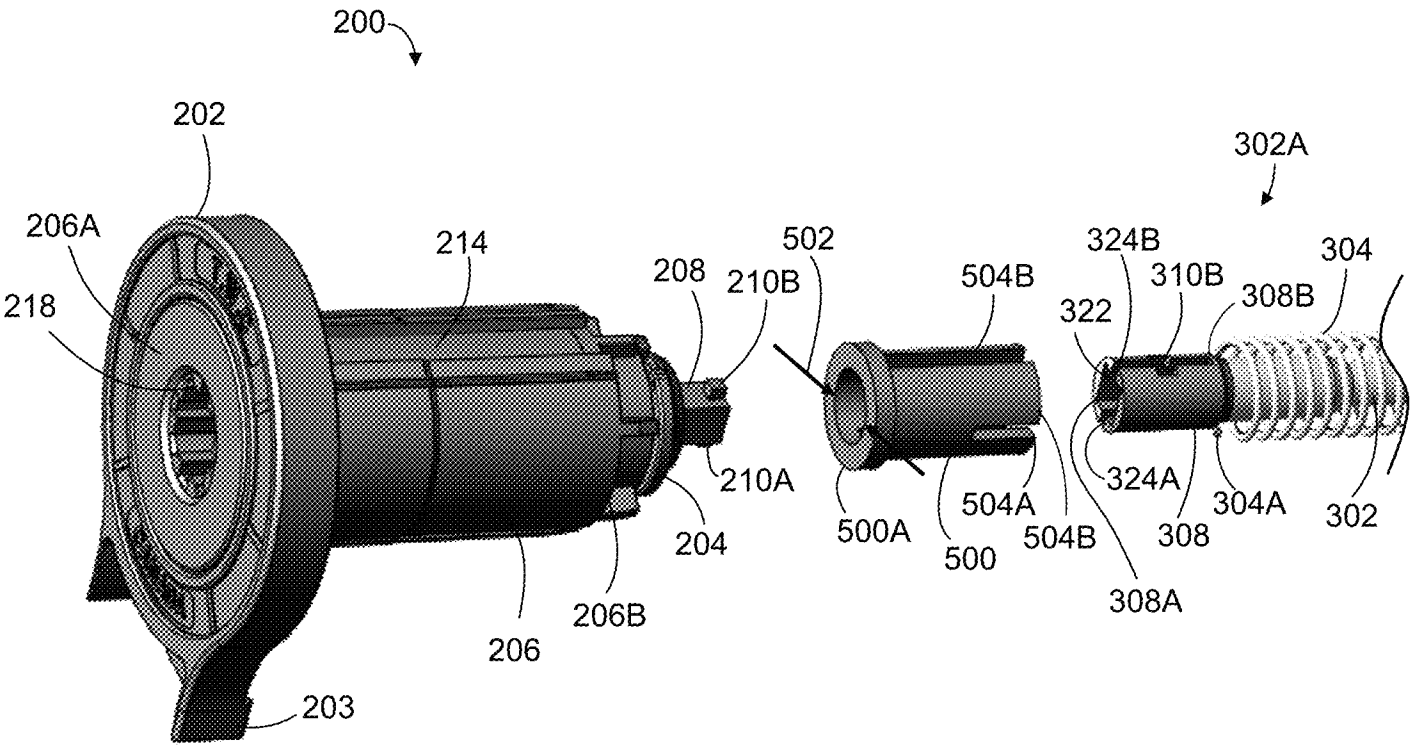
FIG. 5 is a rear perspective view of the clutch assembly, the locking collar and the portion of the pre-torsioned spring assembly shown in FIG. 4.
Figure 6:
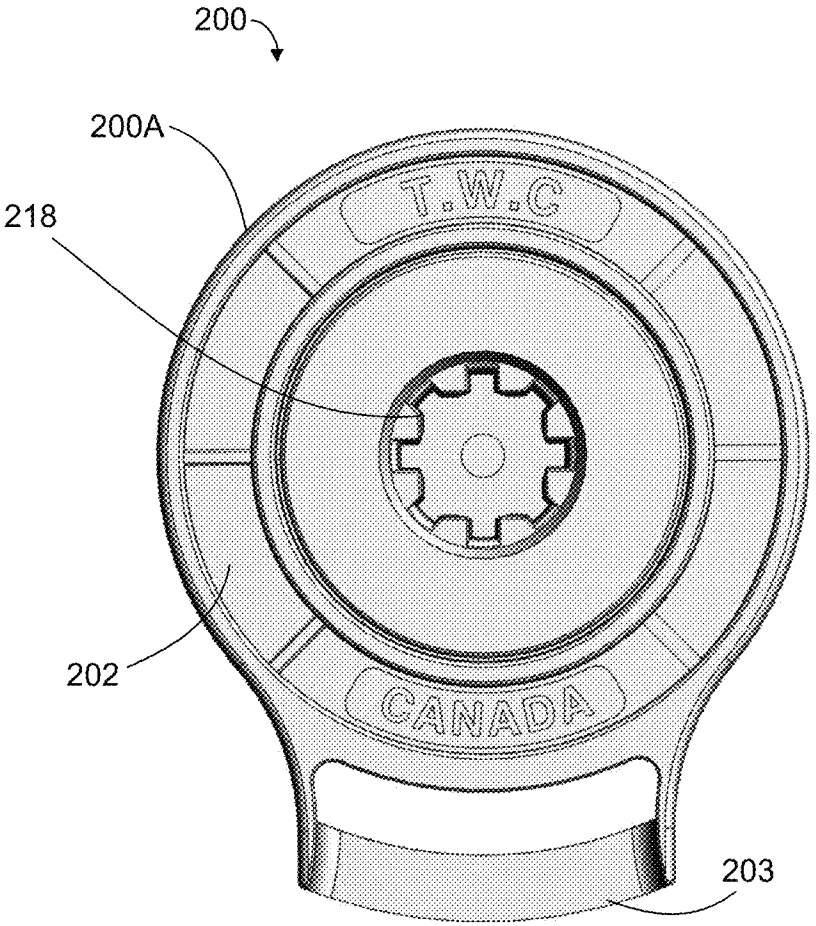
FIG. 6 is a rear plan view of the clutch assembly shown in FIG. 4.

Referring to FIGS. 5 and 6, blind roll engaging member 206 rotates relative to the end plate 202 and the shaft coupling member 204. In the illustrated example, the first end 206A is seated within an aperture of end plate 202. The shaft coupling member 204 is fixedly (i.e. non-rotationally) coupled to the end plate 202. For example, shaft coupling member 204 may be integrally formed with end plate 202, or may be mechanically fastened to the end plate 202, e.g. using a press fit. Thus, the blind roll engaging member 206 may be rotated about the shaft coupling member 204. In this way, the blind roll engaging member 206 may be rotated relative to both the bracket engagement member 202 and the shaft coupling member 204.

Preferably, the clutch assembly 200 includes a lock spring (not shown) or other biasing member to exert a holding torque to inhibit or prevent rotation between the shaft coupling member 204 and the blind roll engaging member 206. For example, one or more torsion springs may be positioned around an exterior circumferential surface of the shaft coupling member 204. Such torsion springs may be selectively movable between an engaged or contracted state and a released or expanded state. In the engaged state, the lock spring may inhibit or prevent rotation of the blind roll engaging member 206 relative to the shaft coupling member 204. The lock spring may remain in the engaged state until a net torque that is greater than the holding torque is applied to the blind roll engaging member 206. Thus, when the net torque applied to the blind roll engaging member 206 (e.g. the difference between torque applied by spring assembly 300 and torque applied by the weight of hanging blind material) is below the holding torque, the lock spring may inhibit or prevent rotation of the blind roller 400.

The blind roll engaging member 206 is preferably configured to fit within the cavity 404 of blind roller 400. In the example shown, the blind roll engaging member 206 has a generally cylindrical outer surface (e.g. it may be made from a cylindrical extrusion) and has an external diameter 212. Preferably, the external diameter 212 of blind roll engaging member 206 is slightly smaller than the internal diameter 406 of blind roller 400. In this way, the blind roll engaging member 206 may fit securely within the cavity 404 of blind roller 400. For example, the outer surface of blind roll engaging member 206 and the inner surface of wall 402 may be sized to provide a friction fit between blind roll engaging member 206 and blind roller 400.

Turning to FIG. 3, the shaft coupling member 204 is preferably longer than the blind roll engaging member 206, with a portion of the shaft coupling member 204 protruding from the second end 206B. The protruding portion may include a locking head 208.

Figure 2:
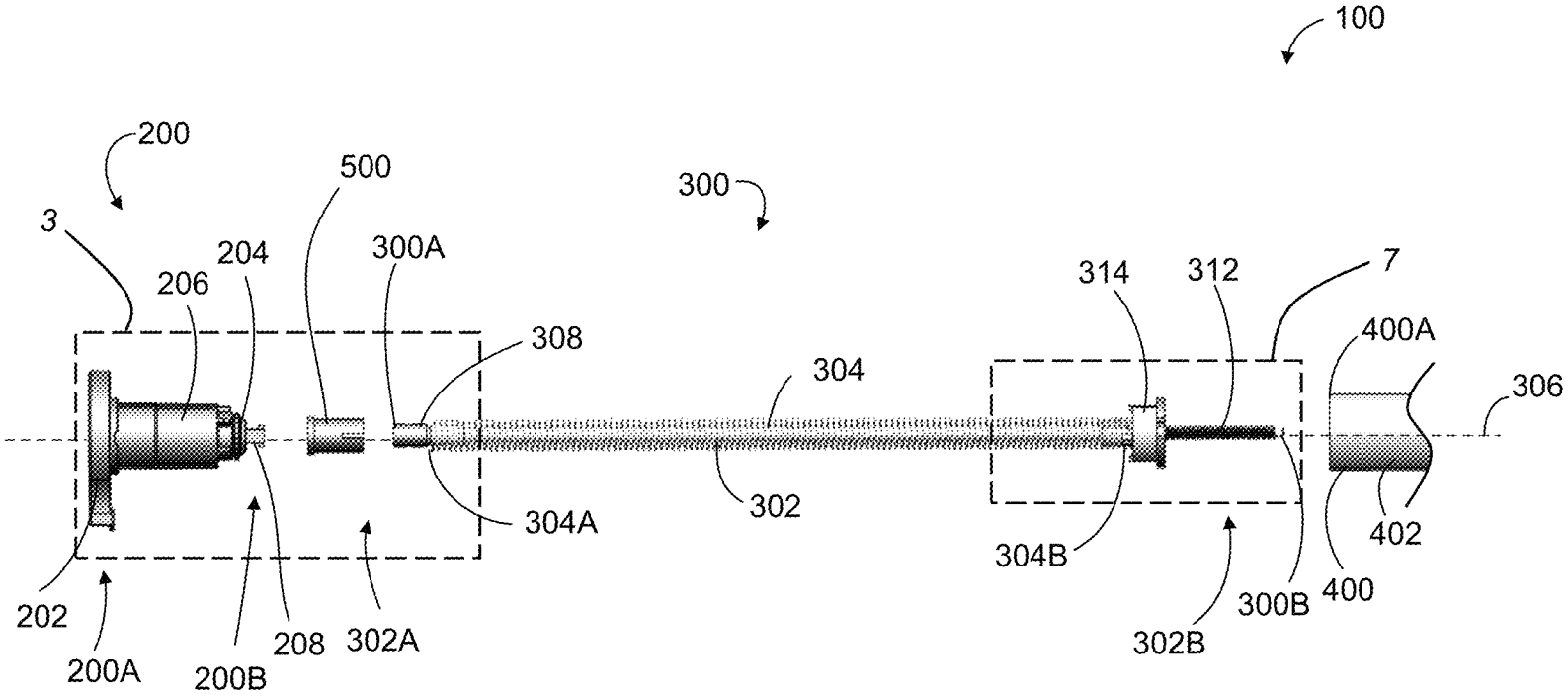
FIG. 2 is an exploded side plan view of the example roller blind assembly shown in FIG. 1.

Returning to FIG. 1, spring assembly 300 includes a shaft 302 and a spring 304 positioned around the shaft 302. Spring 304 may be a coil spring. Referring to FIG. 2, shaft 302 has a first end 302A and a second end 302B, and extends along a central axis 306 between the first and second ends 302A and 302B. Spring assembly 300 also includes a coupling section 308 extending from the first end 302A of the shaft 302. In the illustrated example, the coupling section 308 is integrally formed with the shaft 302. In one or more alternative embodiments, the coupling section 308 may be connected to the first end 302A of shaft 302 in other suitable ways, e.g. threaded engagement, press fit, etc. The coupling section 308 may be used to couple the first end 300A of spring assembly 300 to the shaft coupling side 200B of clutch assembly 200.

Referring to FIG. 5, the coupling section 308 of shaft 302 has an opening 322 defined in an end surface thereof. In the example shown, the coupling section 308 is a cylindrical coupling section; however, it will be appreciated that other configurations are possible. The opening 322 is configured to receive the locking head 208.

During assembly, the locking head 208 of shaft coupling member 204 is inserted within the opening 322 of coupling section 308, and this engagement between the locking head 208 and the opening 322 of coupling section 308 secures the clutch assembly 200 to the spring assembly 300. In the example shown, the cross-sectional shape of locking head 208 and the opening 322 are each generally rectangular. However, it will be appreciated that other mating configurations are possible, such as triangular, hexagonal, octagonal, etc. Further, in the illustrated example, the shaft coupling member 204 and locking head 208 may be characterized collectively as a 'male' connector, and the opening 322 of coupling section 308 may be characterized as a 'female' connector. It will be appreciated that in one or more alternative embodiments, coupling section 308 may be configured as a 'male' connector and shaft coupling member 204 may be configured as a 'female' connector. For example, shaft coupling member 204 may include an opening for mating engagement with a locking head provided at an end of coupling section 308.

In some embodiments, the locking head 208 and the coupling section 308 may each include one or more complementary registration features to secure the connection between the clutch assembly 200 and the spring assembly 300 in a predetermined alignment. Referring to FIGS. 3 and 5, the locking head 208 includes protrusions 210A and 210B extending radially outwardly therefrom, and the coupling section 308 includes apertures or recesses 310A and 310B configured to receive the protrusions 210A and 210B therein to couple the clutch assembly 200 and the spring assembly 300. In the example shown, the protrusions 210A and 210B and the recesses 310A and 3108 each have generally rectangular cross-sectional profiles. However, it will be appreciated that other mating configurations are possible, such as triangular, circular, rounded, etc.

The coupling section 308 may be made from a resilient material, e.g. a plastic material, to simplify inserting and removing the protrusions 210A and 210B from the apertures 310A and 310B. In the illustrated example, the coupling section 308 includes longitudinal slots 324A and 324B that extend longitudinally from a first outer edge 308A toward a second outer edge 308B, passing through the apertures 310A and 310B, respectively. When the locking head 208 is inserted into the opening 322, the opening 322 may be expanded by deformation of the coupling section 308 along the longitudinal slots 324A and 324B. This temporary expansion of the opening 322, between the first outer edge 308A and the apertures 310A and 310B, allows the protrusions 210A and 210B of locking head 308 to be aligned with and be positioned within the apertures 310A and 310B.

In the illustrated example, the roller blind assembly 100 includes a locking collar 500 to further secure the connection between the clutch assembly 200 and the spring assembly 300. In the example shown, the locking collar 500 has a cylindrical shape and is positionable around the locking head 208 and the cylindrical coupling section 308 to inhibit radially outward deformation of the coupling section 308. An internal dimension 502 of the locking collar 500 is preferably slightly larger than an external dimension 326 of the coupling section 308. With the locking collar 500 positioned around the coupling section 308, the protrusions 210A and 210B are retained within the apertures 310A and 310B, respectively. Accordingly, the locking collar 500 may inhibit or prevent the protrusions 210A and 2106 of locking head 208 from disengaging with the apertures 310A and 3106 of coupling section 308.

The locking collar 500 may be made from a resilient material, such a plastic material, to simplify positioning the locking collar 500 around the locking head 208 and the coupling section 308. In the illustrated example, the locking collar 500 includes longitudinal slots 504A, 504B, 504C, and 504D that extend longitudinally from a second collar edge 500B toward a first collar edge 500A. In the example shown, the longitudinal slots 504B and 504D are longer than the longitudinal slots 504A and 504C. The internal dimension 502 of locking collar 500 may be expanded by deformation of the locking collar 500 along longitudinal slots 504A, 504B, 504C, and 504D. Temporary expansion of the internal dimension 502 may simplify positioning the locking collar 500 around the coupling section 308 to retain the protrusions 210A and 2106 of locking head 208 within apertures 310A and 310B of coupling section 308.

Figure 7:
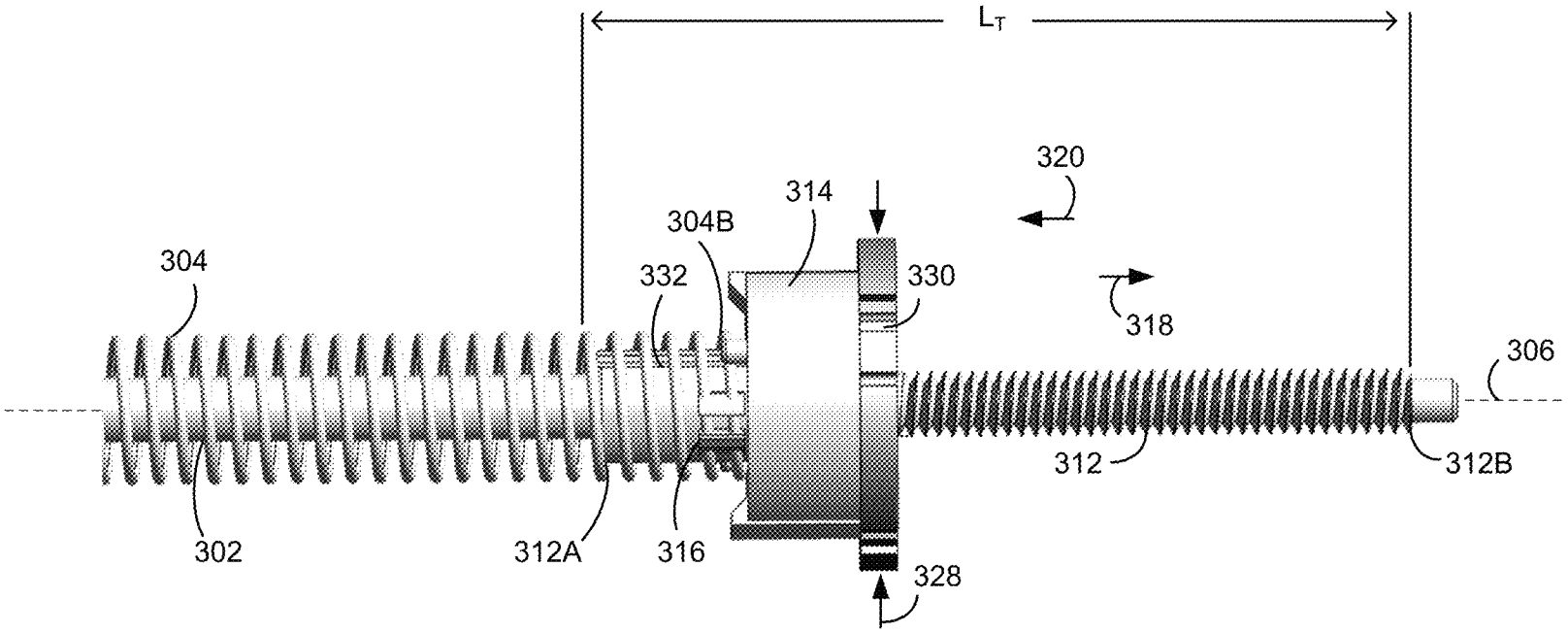
FIG. 7 is an enlarged view of the example roller blind assembly taken at portion 7 of FIG. 2.

The second end 302B of shaft 302 includes a threaded section 312. Turning to FIG. 7, the threaded section 312 extends along a thread length LT from a first thread end 312A to a second thread end 312B along the central axis 306.

Returning to FIG. 2, the spring 304 extends around the shaft 302 from a first spring end 304A to a second spring end 304B. In the illustrated example, shaft 302 is positioned through the interior of spring 304 such that the spring 304 is substantially co-axial with the central axis 306 of shaft 302. The first spring end 304A is fixedly coupled to the first end 302A of shaft 302. For example, the first end 302A of shaft 302 may have a spring locking groove (not shown) defined therein for receiving and securing the first spring end 304A. It will be appreciated that first spring end 304A may be fixedly coupled to the first end 302A of shaft 302 in other suitable ways, e.g. by welding, clamping, etc.

The spring assembly 300 also includes a restraining assembly 314 movably engaged with the threaded section 312 of shaft 302. In the illustrated example, the restraining assembly 314 has a threaded internal passage (such as a bore) defined therethrough that is suitably sized for threaded engagement with the threaded section 312 of shaft 302.

The restraining assembly 314 is configured to fit within the cavity 404 of blind roller 400. In the example shown, the restraining assembly 314 is generally cylindrical and has an external diameter 328. Turning to FIG. 8, the external diameter 328 of restraining assembly 314 is smaller than the internal diameter 406 of cylindrical blind roller 400. In this way, the restraining assembly 314 may fit within the cavity 404 of blind roller 400, and still be able to rotate about the threaded section 312 in order to move along the central axis 306.

In the illustrated example, restraining assembly 314 includes a spring locking protrusion or clip 316 defined on an outer circumferential surface of the restraining assembly 314. Referring to FIG. 7, this arrangement allows the second spring end 304B to be fixedly coupled to the restraining assembly 314 by the spring locking clip 316. In one or more alternative embodiments, the second spring end 304B may be fixedly coupled to the restraining assembly 314 in another suitable manner, e.g. by welding, clamping, etc.

The restraining assembly 314 may move along the central axis 306 of shaft 302 between the first and second thread ends 312A and 312B. In the illustrated example, rotation of the restraining assembly 314 around the threaded section 312 results in movement of the restraining assembly 314 along the central axis 306 (due to their threaded engagement). With the second spring end 304B fixedly coupled to the restraining assembly 314 and the first spring end 304A fixedly coupled to the first end 302A of shaft 302, rotation of the restraining assembly 314 along threaded section 312 moves the second spring end 304B in relation to the first spring end 304A. As a result, the spring 304 may expand and contract along the central axis 306 of shaft 302 in response to the restraining assembly 314 being rotated about the central axis 306.

As the restraining assembly 314 moves toward the second thread end 312B along the central axis 306, the spring 304 is loaded, thereby adding torsion to the spring 304. Accordingly, the direction 318 from the first thread end 312A toward the second thread end 312B may be characterized as a torsioning direction 318.

In contrast, moving the restraining assembly 314 towards the first thread end 312A relaxes spring 304, thereby reducing torsion in the spring 304. Accordingly, the direction 320 from the first thread end 312A toward the second thread end 312B may be characterized as a torsion reducing direction 320.

Figure 11:
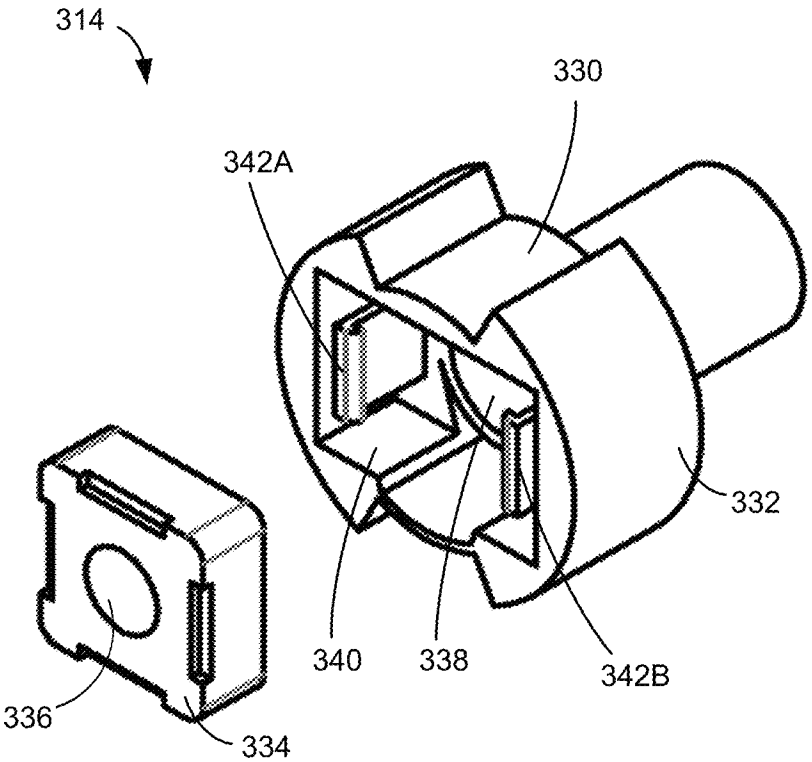
FIG. 11 is an exploded front perspective view of the restraining assembly shown in FIG. 10.
Figure 10:
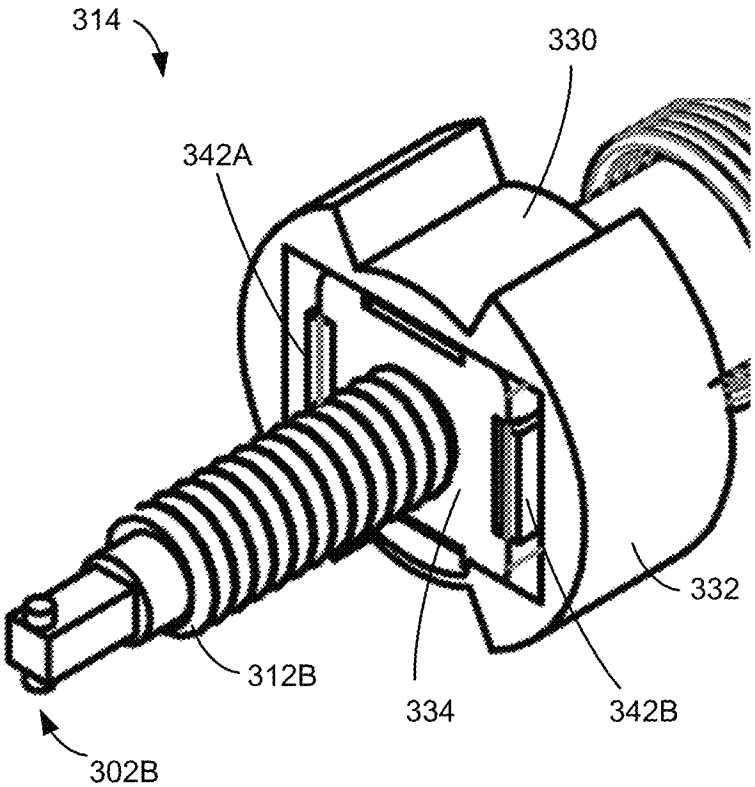
FIG. 10 is an enlarged front perspective view of an example restraining assembly engaged with a threaded section of a pre-torsioned spring assembly that may be used in the example roller blind assembly of FIG. 1.

Referring to FIGS. 10 and 11, the spring assembly 300 also preferably includes a restraining member, such as a restraining nut 334, to inhibit or prevent unwanted loosening of spring 304. As best shown in FIG. 11, restraining assembly 314 comprises a restraining body 332 and the restraining nut 334. Restraining nut 334 has a threaded internal passage 336 (such as a bore) defined therethrough. The threading of internal passage 336 is omitted from FIG. 11 for clarity. The internal passage 336 is sized for threaded engagement with the threaded section 312 of shaft 302.

As best shown in FIG. 11, restraining body 332 has a preferably non-threaded internal passage 338 (such as a bore) defined therethrough. The internal passage 338 is sized so that shaft 302 may pass freely therethrough.

With continued reference to FIG. 11, restraining body 332 may have a restraining nut engagement recess, such as a recessed portion 340 defined in an end surface thereof. As shown, recessed portion 340 and internal passage 338 define a continuous passage that allows shaft 302 to pass therethrough. The recessed portion 340 is sized to mate with restraining nut 334. In the illustrated example, the restraining nut 334 is snap fit into the recessed portion 340 by a pair spring clips 342A and 342B located on opposite sides of the recessed portion 340. Once the restraining nut 334 is located within the recessed portion 340, the clips 342A and 342B retain the restraining nut 334 within the recessed portion 340 and prevent it from unintentionally popping out of the recessed portion 340.

To remove the restraining nut 334 from the recessed portion 340, the spring clips 342A and 342B may be deformed away from one another while the restraining nut 334 is pulled away from the recessed portion 340. Those skilled in the art will appreciate that clips 342A and 342B are one of many possible alternatives for maintaining engagement between the restraining body 332 and the restraining nut 334. Other alternatives may include a locking pin, a clamp, a screw, or other suitable mechanical fasteners. In other embodiments, restraining nut 334 may be friction or press fit within the recessed portion 340 of the restraining body 332.

In the illustrated example, the restraining nut 334 has a quadrangular body. Recessed portion 340 defines a corresponding quadrangular space configured to mate with the quadrangular body of the restraining nut 334. It will be appreciated that other mating configurations are possible, such as triangular, hexagonal, octagonal, etc.

The threaded internal passage 336 of restraining nut 334 is engaged with the threaded section 312 at the second thread end 312B. The restraining nut 334 is rotated until reaching the first thread end 312A. The restraining nut 334 is prevented from rotating past the first thread end 312A due to the lack of threading beyond this point. In this way, the junction between the first thread end 312A and shaft 302 acts as a 'stop' that prevents further rotation of the restraining nut 334.

As described above, the first end 304A of spring 304 is fixedly secured to the first end 302A of the shaft 302 and the second end 304B of spring 304 is fixedly secured to the restraining body 332 (e.g. by spring locking clip 316 as shown in FIG. 7).

The restraining body 332 may then be rotated a predetermined number of times to apply a preset torsion to the spring 304. Following application of the preset torsion, the recessed portion 340 of restraining body 332 and the restraining nut 334 are engaged (e.g. snapped together as shown in FIG. 10).

Referring to FIG. 10, when the restraining nut 334 is engaged with the recessed portion 340 of the restraining body 332, relative rotation between the restraining body 332 and the restraining nut 334 is substantially prevented. Since restraining nut 334 is positioned at the junction between the first thread end 312A and the shaft 302, the torsion in the spring 304 is unable to move the restraining nut 334 in the torsion reducing direction 320 (see FIG. 7). Thus, the preset torsion applied to the spring 304 may be retained. A spring assembly configured to maintain the preset torsion may be characterized and referred to herein as a pre-torsioned spring assembly 300.

By providing a restraining member (e.g. restraining nut 334) to inhibit or prevent unwanted loosening of the spring 304, spring assembly 300 may be configured to maintain an initial 'pre-torsion' applied to the spring 304, e.g. during storage and/or transport of the spring assembly 300.

In some embodiments, shaft 302 may include an optional projection (not shown) at, or adjacent to, the first thread end 312A. The projection may aid in preventing the threaded internal passage 336 of restraining nut 334 from disengaging the threaded section 312 at the first thread end 312A. That is, the projection may help prevent the restraining nut 334 from rotating over an unthreaded portion of the shaft 302. For example, when the restraining assembly 314 is moving in the torsion reducing direction 320, the projection may prevent disengagement of the threaded internal bore of restraining assembly 314 with the threaded section 312 of shaft 302 due to over-rotation.

Once the clutch assembly 200 is coupled to the pre-torsioned spring assembly 300, e.g. as described above, the blind roller 400 may be attached. Turning to FIG. 8, blind roller 400 has a groove 408 defined in the outer wall 402 that protrudes into the roll cavity 404. The groove 408 may extend between the first roll end 400A and the second roll end (i.e. the entire length of blind roller 400).

With continued reference to FIG. 8, restraining assembly 314 has a notch 330 defined in its outer circumferential surface. In the illustrated example, the notch 330 is defined in the outer circumferential surface of restraining body 332. Turning to FIG. 3, the blind roll engaging member 206 has a channel 214 defined in its outer circumferential surface that extends between the first end 206A and the second end 206B. During assembly, both the notch 330 of restraining assembly 314 and the channel 214 of blind roll engaging member 206 receive the groove 408 of blind roller 400. The second end 300B of pre-torsioned spring assembly 300 is preferably inserted into the cavity 404 of blind roller 400. During insertion, the groove 408 of blind roller 400 is aligned with the notch 330 of restraining assembly 314, so that the pre-torsioned spring assembly 300 can be slid into the cavity 404 with the notch 330 engaged in the groove 408.

Figure 12:
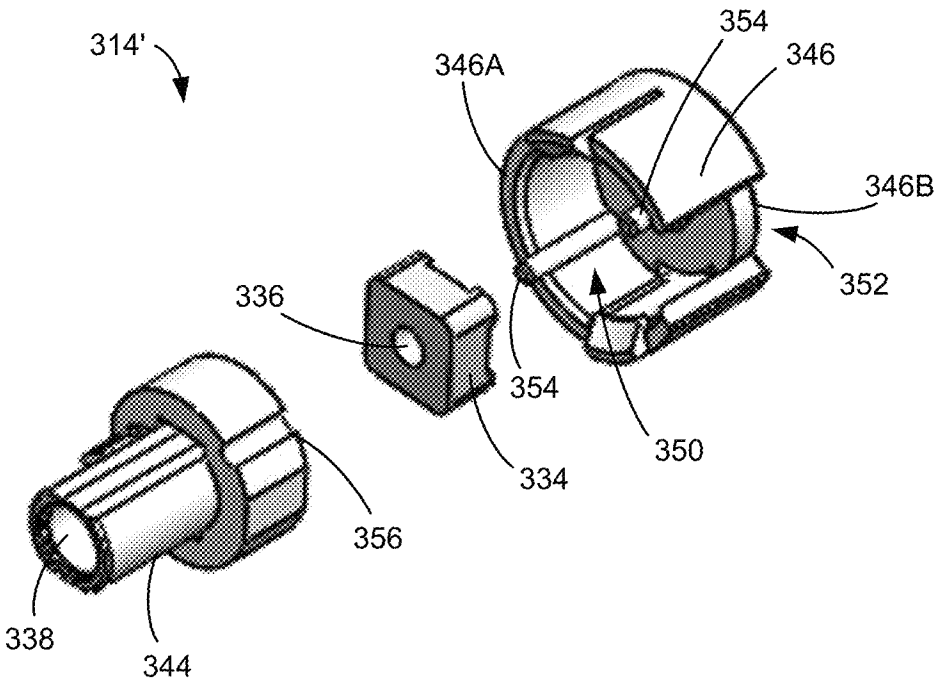
FIG. 12 is an exploded rear perspective view of another example restraining assembly that may be used in the example roller assembly of FIG. 1.

FIG. 12 illustrates a restraining assembly 314'. Restraining assembly 314' is analogous to restraining assembly 314 shown in FIGS. 10 and 11, except that the restraining body comprises two components. The restraining body comprises a sleeve portion 344 and a cap 346. The cap 346 can be mounted to the sleeve portion 344. The cap 346 includes a substantially cylindrical outer wall 348 that extends between an open first cap end 346A and a closed second cap end 346B. The outer wall 348 and the closed second cap end 346B define an interior cavity 350 within the cap 346.

With continued reference to FIG. 12, the outer wall 348 of the cap 346 has a longitudinal gap 352 extending between the first and second cap ends 346A and 346B. When the sleeve portion 344 is engaged within the interior cavity 350 of cap 346, the gap 352 and the exterior circumferential surface of sleeve portion 344 define a notch of restraining assembly 314'. As with notch 330, the notch of this embodiment engages the groove 408 of blind roller 400.

In the illustrated example, cap 346 has a pair of longitudinally extending ridges 354 defined on outer wall 348 along an inner surface thereof. The sleeve portion 344 has a pair of longitudinally extending slots 356 defined in its outer circumferential surface. One of the slots 356 is not visible in FIG. 12. Each ridge 354 of cap 346 is aligned with a corresponding slot 356 of sleeve portion 344 so that the sleeve portion 346 slides into the interior cavity 350 of the cap 346. When ridges 354 are received within corresponding slots 356, relative rotation between cap 346 and sleeve portion 344 is prevented. Those skilled in the art will appreciate that alternate configurations to prevent relative rotation between the cap 346 and the sleeve portion 344 may be provided.

As described above, the external diameter 328 of restraining assembly 314 is smaller than the internal diameter 406 of cylindrical blind roller 400 so that the restraining assembly 314 may fit within the cavity 404 of blind roller 400. However, the external diameter 328 must be large enough so that the notch 330 can engage the groove 408 of the blind roller 400.

The internal diameter 406 can vary across blind rollers 400. For example, one blind roller may have an internal diameter of 4 cm while another blind roller may have an internal diameter of 8 cm. To account for such variance, a plurality of caps 346 with different external diameters may be provided. For example, the outer wall 348 of cap 346 may be thicker for blind rollers with greater internal diameters than for smaller internal diameters. By providing caps of many diameters, no modifications are needed to other parts of the restraining assembly 314' to ensure a proper fit. For example, restraining nut 334 and sleeve portion 344 can be manufactured to one standardized size that can be used in a wide range of roller blind assemblies. In this context, the cap 346 may be characterized as an "adapter" that is selected according to the internal diameter 408 of the blind roller 400 to ensure a suitable fit. This may reduce manufacturing costs and/or simplify assembly.

Turning to FIG. 9, once pre-torsioned spring assembly 300 is inserted within the cavity 404, the clutch assembly 200 may be at least partially inserted into the cavity 404 of blind roller 400. When inserting the clutch assembly 200 into the cavity 404, the channel 214 of blind roll engaging member 206 may be aligned with the groove 408 of blind roller 400, so that the blind roll engaging member 206 can be slid within the cavity 404 with the channel 214 engaged in the groove 408.

When the roller blind assembly 100 is assembled, the shaft coupling member 204, the blind roll engaging member 206, the spring 304, the restraining assembly 314, and the blind roller 400 may be substantially co-axial with the central axis 306 of shaft 302.

Once assembled, a blind may be selectively positioned at any point between a fully raised position, in which the blind is substantially completely rolled around the blind roller 400, and a fully lowered position, in which the blind is substantially completely unrolled from the blind roller 400. Roller blind assembly 100 is preferably assembled with the blind substantially completely rolled around the blind roller 400. In this way, the restraining assembly 314 is located at the first thread end 312A when the blind is in the fully raised position.

The blind may be raised or lowered by rotating blind roller 400 about the central axis 306 of shaft 302. As the blind roller 400 rotates, engagement between i) the groove 408 and the notch 330, and ii) the groove 408 and the channel 214 causes the restraining assembly 314 and the blind roll engaging member 206 to rotate in unison with the blind roller 400.

As the position of the blind is adjusted, pre-torsioned spring assembly 300 may apply, to the blind roll engaging member 206, a torque which varies based on the relative position of the blind between the fully raised and fully lowered positions. Specifically, the spring 304 applies a torque to the blind roll engaging member 206 due to engagement between the groove 408 of blind roller 400 and the channel 214 of blind roll engaging member 206. Due to the engagement between the groove 408 of blind roller 400 and the notch 330 of restraining assembly 314, rotation of the blind roller 400 causes the restraining assembly 314 to rotate about the central axis 306 of shaft 302 (which does not rotate). Thus, rotation of the restraining assembly 314 about the central axis 306 causes the restraining assembly 314 to move between the first thread end 312A and the second thread end 3126 of threaded section 312.

As described above, the restraining body 314 is preferably engaged with the threaded section 312 of shaft 302 at the first thread end 312A when the blind is in a fully raised position. In this arrangement, as the blind is lowered, the restraining assembly 314 moves in the torsioning direction 318 along the threaded section 312 and spring 304 is stretched or lengthened. As the blind is raised, the restraining assembly 314 moves in the torsion reducing direction 320 along the threaded section 312 and spring 304 is relaxed or shortened. Torsion in the spring 304 remains greater than or equal to the preset torque throughout rotation of the blind roller 400 since the restraining assembly 314 is unable rotate past the first thread end 312A when moving in the torsion reducing direction 320.

The torque applied to the blind roll engaging member 206 by the pre-torsioned spring assembly 300 is lower when the restraining assembly 314 is positioned towards the first thread end 312A compared to when the restraining assembly 314 is positioned towards the second thread end 312B. This is because the torsion in the spring 304 is lower when the restraining assembly 314 is positioned towards the first thread end 312A, and higher when the restraining assembly 314 is positioned towards the second thread end 312B.

As a result, the downward force required to be applied by a user to lower the blind may be substantially constant, regardless of the blind's position. For example, the downward force required to lower the blind from the fully raised position to the mid-way position may be substantially the same as the downward force required to lower the blind from the mid-way position to the fully lowered position. Similarly, the upward force required to be applied by a user to raise the blind may be substantially constant, regardless of the blind's position. In this way, the roller blind assembly 100 may advantageously permit smooth up and down movement of the blind as it is lowered and raised.

The varying torque applied by the pre-torsioned spring assembly 300 preferably allows the roller blind assembly 100 to hold a blind in a static state (in which the blind does not move up or down) at any position between the fully raised and fully lowered positions. In such a static state, the torque applied to the blind roll engaging member 206 by the pre-torsioned spring assembly 300 (tending to raise the blind) may be substantially equal to the torque applied to the blind roll engaging member 206 from the weight of the blind material suspended from a position offset from the axis of the blind roller 400 (tending to lower the blind). As discussed above, provided the net torque applied to the blind roll engaging member 206 (e.g. the difference between torque applied by spring assembly 300 and torque applied by the weight of hanging blind material) is below the holding torque of blind roll engaging member 206, the clutch assembly 200 will inhibit or prevent rotation of the blind roller 400. Only once a net torque above the holding torque is applied to the blind roll engaging member 206 will the clutch assembly 200 permit rotation of the blind roller 400.

Figure 4:
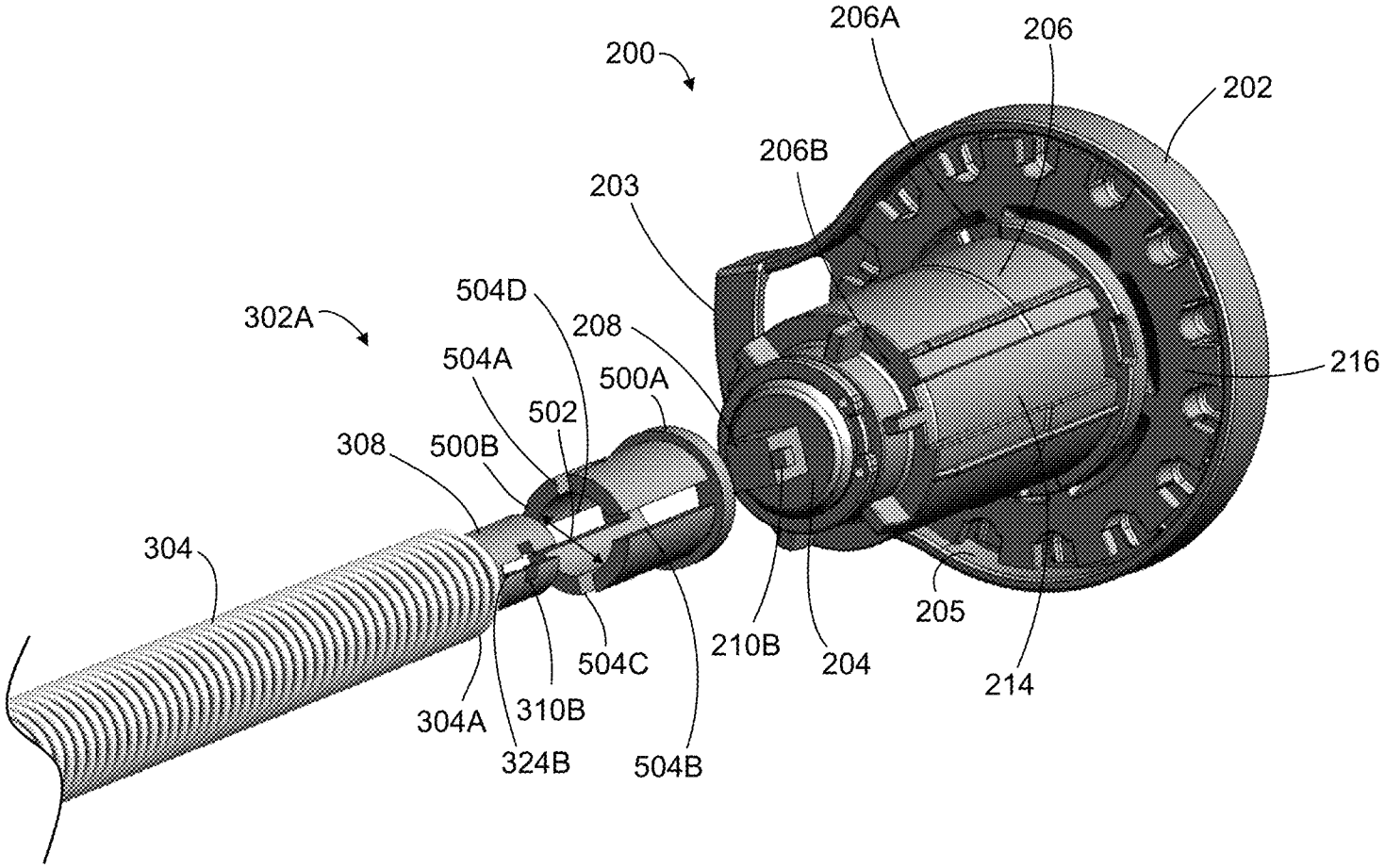
FIG. 4 is a top perspective view of a clutch assembly, a locking collar, and a portion of a pre-torsioned spring assembly that may be used in the example roller blind assembly of FIG. 1.

Optionally, the blind roll engaging member 206 may include a blind control mechanism to allow a user to selectively control rotation of the blind roller 400. In the illustrated example, the blind roll engaging member 206 includes a blind control dial 216 fixedly coupled around the blind roll engaging member 206 at the first end 206A. Referring to FIG. 4, blind control dial 216 may be configured such that it can be at least partially enclosed within the bracket engagement member 202, e.g. within an outer flange 205 of end plate 202.

In some embodiments, a continuous blind control cord or loop (not shown) may be positioned around the blind control dial 216 such that a portion of the control cord is suspended from the blind control dial 216 and accessible to a user of the roller blind assembly 100. To adjust the position of the blind, the user may pull the suspended portion of the control cord to rotate blind control dial 216. As the blind control dial 216 is fixed to the blind roll engaging member 206, pulling the control cord rotates the blind roll engaging member 206, thereby rotating the blind roller 400.

Alternatively, or additionally, to lower the blind a user may apply a force directly to the blind. For example, by grasping and applying a downward force to a lower portion of the blind material, the user may lower the blind.

As described above, the pre-torsioned spring assembly 300 may apply a torque to the blind roll engaging member 206 sufficient to effectively offset the weight of the hanging blind material. In this way, to raise or lower the blind, a user only needs to apply a force to the blind (and/or to a control cord of the blind control mechanism) sufficient to overcome the holding torque of the clutch assembly 200. Accordingly, roller blind assembly 100 may be characterized as a "lift-assisted" or "light lift" roll blind assembly.

Roller blind assembly 100 may be supported at or above an upper end of a window frame and/or door frame using e.g. a pair of support brackets mounted to a wall or support surface adjacent the window frame and/or door frame. Alternatively, support brackets may be removably coupled to opposite ends of a head rail mounted at or above the upper end of the window frame and/or door frame. Referring to FIG. 6, a recess 218 is defined in the end plate 202 so that it is accessible from the bracket engagement side 200A of the clutch assembly 200. The recess 218 may receive a protrusion (not shown) extending from one of the pair of support brackets in order secure the clutch assembly 200 to that support bracket.

For example, U.S. Pat. No. 10,017,984, published Jul. 10, 2018, discloses an exemplary support bracket to which bracket engagement member 202 may be removably attached. Although not shown, the second roll end of blind roller 400 may be rotatably coupled to a support bracket on the opposite side of the upper end of the window frame and/or door frame.

Roller blind assemblies 100 that include a clutch assembly 200 and a pre-torsioned spring assembly 300 may have one or more advantages. For example, assembly and/or installation of a roller blind assembly 100 may be simplified by providing two or more pre-torsioned spring assemblies that each have different preset torsions. This may allow an assembler and/or an installer to select a pre-torsioned spring assembly that has an appropriate preset torsion value for a particular installation.

It will be appreciated that different pre-torsioned spring assemblies may each have a different applied preset torsion. "Pre-torsioned", in this context, refers to a preset torsion applied to the spring prior to installation of the pre-torsioned spring assembly in a roller blind assembly (e.g. roller blind assembly 100). Providing an appropriate preset torsion to the spring 304 is important for the roller blind assembly 100 to function as the "lift-assisted" roll blind assembly. For example, if the initial preset torsion is too low, the weight of the hanging blind material may be sufficient to overcome the torque applied to the blind roll engaging member 206 by spring assembly 300 and the holding torque of the clutch assembly 200, causing the blind to 'drift' or otherwise move down. Alternatively, if the initial preset torsion is too high, the blind may 'drift' or otherwise move up. As noted above, it may be difficult to ensure a correct preset torsion in a typical spring-assisted blind roller assembly, due to e.g. wide tolerances in typical components, components becoming misadjusted during transit from an assembler's facility to an installation site, and/or incorrect installation by an installer.

In some embodiments, the preset torsion applied to each spring assembly 300 may depend on the properties of spring 304 included therein. For example, a plurality of springs may be available for use in the pre-torsioned spring assembly 300. Each spring 304 may have a different spring constant, a different length, etc. In this way, the selection of a spring from a plurality of different springs for use in a pre-torsioned spring assembly may be based on the required preset torsion or starting torsion for a specific blind roller 400. In some cases, an assembler and/or installer may select a suitable spring based on specifications of the blind (e.g. blind length and weight of the blind material) to be hung from roller blind assembly 100.

In some embodiments, to apply a desired preset torsion to a pre-torsioned spring assembly 300, one end of a spring (e.g. the first spring end 304A of spring 304) may be fixed at one end of a rotation shaft (e.g. the first end 302A of shaft 302). A torsion may then be applied by rotating an opposite end of the spring (e.g. the second spring end 304B of spring 304) a number of 'turns' (i.e. full rotation of one spring end relative to the other spring end) before securing that opposite end of the spring to a restraining body (e.g. restraining assembly 314). The restraining body may be previously engaged with a threaded section (e.g. the threaded section 312) at an opposite end of the rotation shaft. It will be appreciated that as the number of 'turns' is increased, the applied preset torsion may correspondingly increase. Accordingly, a manufacturer and/or assembler may apply a specific preset torsion to each pre-torsioned spring assembly by applying a predetermined number of 'turns' to the spring. The preset torsion can be applied to the spring 304 in this way during manufacture and/or assembly of a pre-torsioned spring assembly 300 or at a time thereafter.

After a pre-torsioned spring assembly 300 is assembled, it may be labelled with the preset torsion that is applied. For example, each pre-torsioned spring assembly can be given a stock keeping unit (SKU) based on its applied preset torsion. In this way, an inventory of pre-torsioned spring assemblies can be kept, and an appropriate pre-torsioned spring assembly 300 can be selected from inventory based on its SKU.

For example, an assembler and/or an installer may determine a required preset torsion or preset torsion range for a particular blind installation (e.g. based on the width and height of the blind, and the weight of the blind material). In some cases, the assembler/installer may consult a table or matrix of predetermined pre-torsion values to determine the required preset torsions or preset torsion range. Using roller blind assembly 100 as an example, an assembler and/or an installer selecting components to be used for a particular blind installation may determine a desired preset torsion for the pre-torsioned spring assembly, e.g. by consulting a table with a blind length (i.e. vertical dimension) a blind width (i.e. horizontal dimension) and a weight for the blind material to be supported by blind roller 400. The installer can then select a pre-torsioned spring assembly 300 that has a rated preset torsion that best matches the desired preset torsion. In some cases, the required preset torsion for the pre-torsioned spring assembly may be determined as a range. In such cases, the installer may select a pre-torsioned spring assembly that has a specified preset torsion that falls within the determined range.

In some cases, once an installer determines the specifications of the blind to be supported by the roller blind assembly, they can order an appropriate pre-torsioned spring assembly 300. For example, the pre-torsioned spring assembly 300 may be ordered from a warehouse that stocks pre-torsioned spring assemblies with different preset torsions. In this way, components for the roller blind assembly 100 may packaged and/or provided to the installer without the need for pre-installation assembly and/or testing. In such embodiments, the components of roller blind assembly 100 may be characterized as facilitating 'plug-and-play' installation.

Optionally, an installer may bring multiple spring pre-torsioned spring assemblies to the site where the roller blind assembly 100 is to be installed. For example, an installer may have their own inventory of pre-torsioned spring assemblies with different preset torsions that they bring on an installation site. Once the installer determines the required preset torsion (or preset torsion range), they can simply pull the most appropriate pre-torsioned spring assembly from their inventory. This may be advantageous when the installer does not know the exact specifications of the blind roller 400 in advance of installation. Additionally, or alternatively, if an installed roller blind assembly 100 is unexpectedly exhibiting undesirable performance, the installer may be able to simply replace the initial pre-torsioned spring assembly with an alternative pre-torsioned spring assembly that has a different preset torsion. For example, if the initial assembly is not providing enough torque (e.g. if the blind is drifting down), instead of trying to adjust the spring assembly, a pre-torsioned spring assembly that has a higher spring preset torsion may simply be substituted for the initially installed spring assembly.

In some embodiments, an installer may be provided with a kit that includes a blind roller 400, a clutch assembly 200, and at least two pre-torsioned spring assemblies 300.

As described above, an assembler or installer may determine a required preset torsion of a pre-torsioned spring assembly, e.g. by consulting a table of values for different lengths, widths, and fabric weights for the particular blind to be hung from blind roller 400. The installer can then select an appropriate pre-torsioned spring assembly 300 (e.g. one that has a preset torsion that best matches the required preset torsion) from a number of different pre-torsioned spring assemblies.

Additionally, or alternatively, a specific preset torsion based on the specifications of the blind roll 400 to be used in the roller blind assembly 100 may be applied, in advance, using the restraining body 332 and the restraining nut 334 of restraining assembly 314, as described above with reference to FIGS. 10 and 11.

In some cases, during or after installation, an installer may test the roller blind assembly 100 and determine that a torsion adjustment is needed to improve operation. As discussed above, the shaft coupling member 204 may be connected to the first end 302A of shaft 302 via engagement between the locking head 208 and the coupling section 308. To adjust the applied preset torsion of the pre-torsioned spring assembly 300, an installer may rotate the bracket engagement member (e.g. end plate 202) with one hand while grasping the blind roller 400 with the other hand. Since the end plate 202 may be fixedly coupled to the shaft coupling member 204, rotating the end plate 202 in this manner may also rotate the shaft coupling member 204 relative to the blind roller 400. As the shaft coupling member 204 is rotated relative to the blind roller 400, the shaft 302 may rotate without rotating the restraining body 314. As discussed above, the first end 304A of spring 304 may be fixedly coupled to the first end 302A of shaft 302 and the second end 304A of spring 304 may be fixedly coupled to the restraining body 314. Accordingly, rotating the shaft 302 without rotating the restraining body 314 may increase or decrease the torsion in the spring 304. Thus, in the manner described above, torsion may be increased or reduced in the spring 304 as needed.

Figure 13:
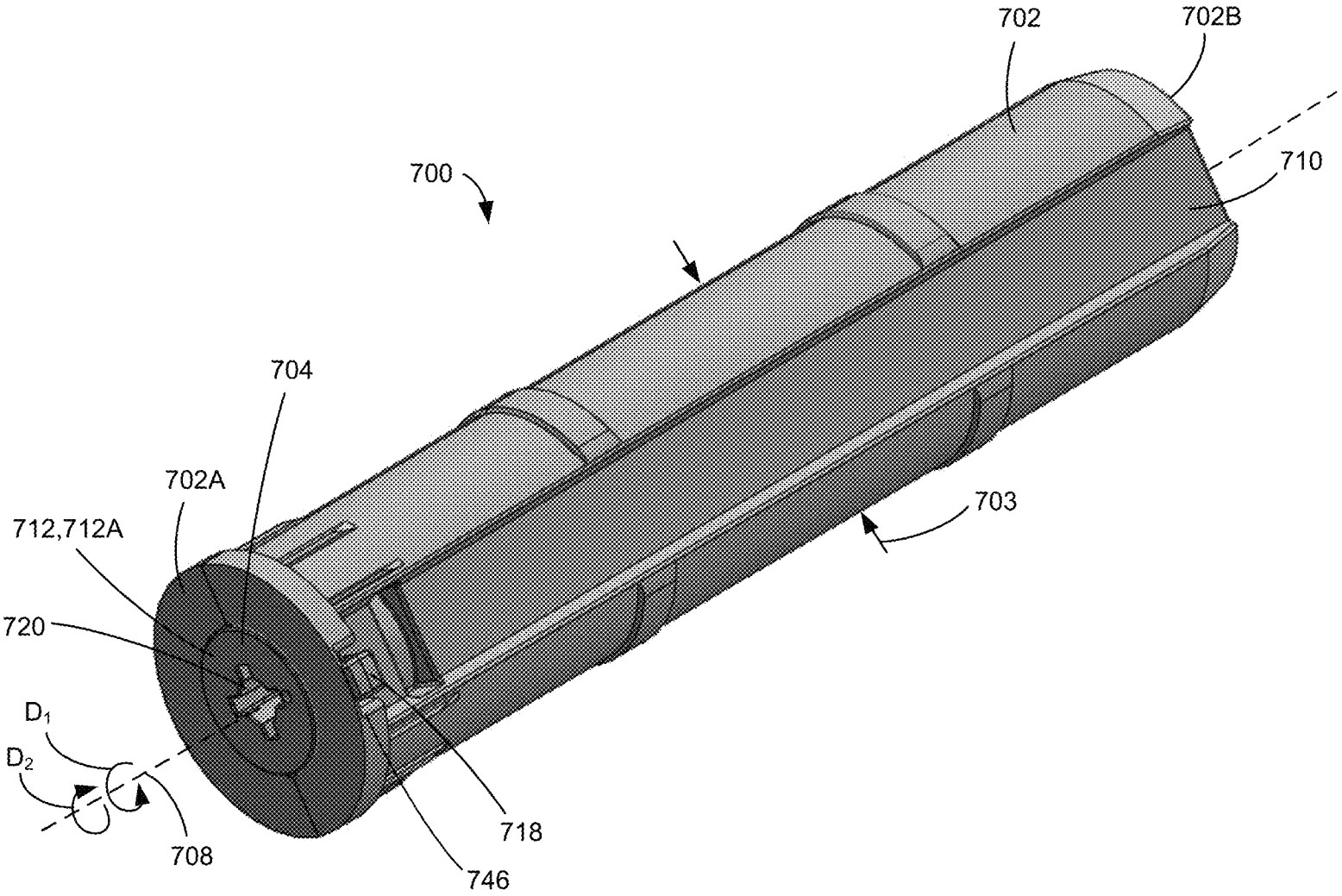
FIG. 13 is a side perspective view of a holding assembly that may be used in an example roller assembly in accordance with an embodiment.
Figure 14:
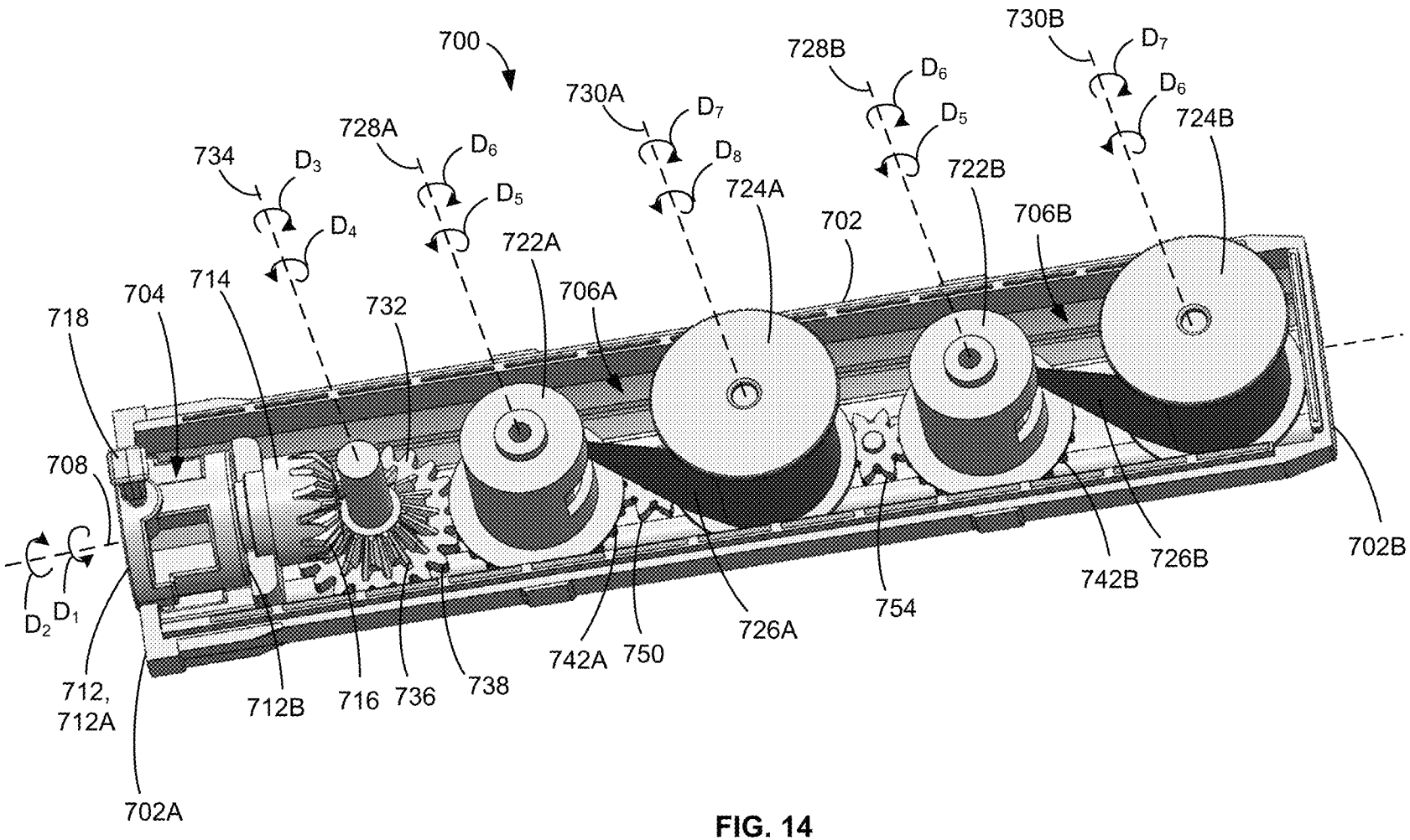
FIG. 14 is a top perspective view of the holding assembly shown in FIG. 13 with a portion of the housing removed to illustrate internal components.
Figure 15:
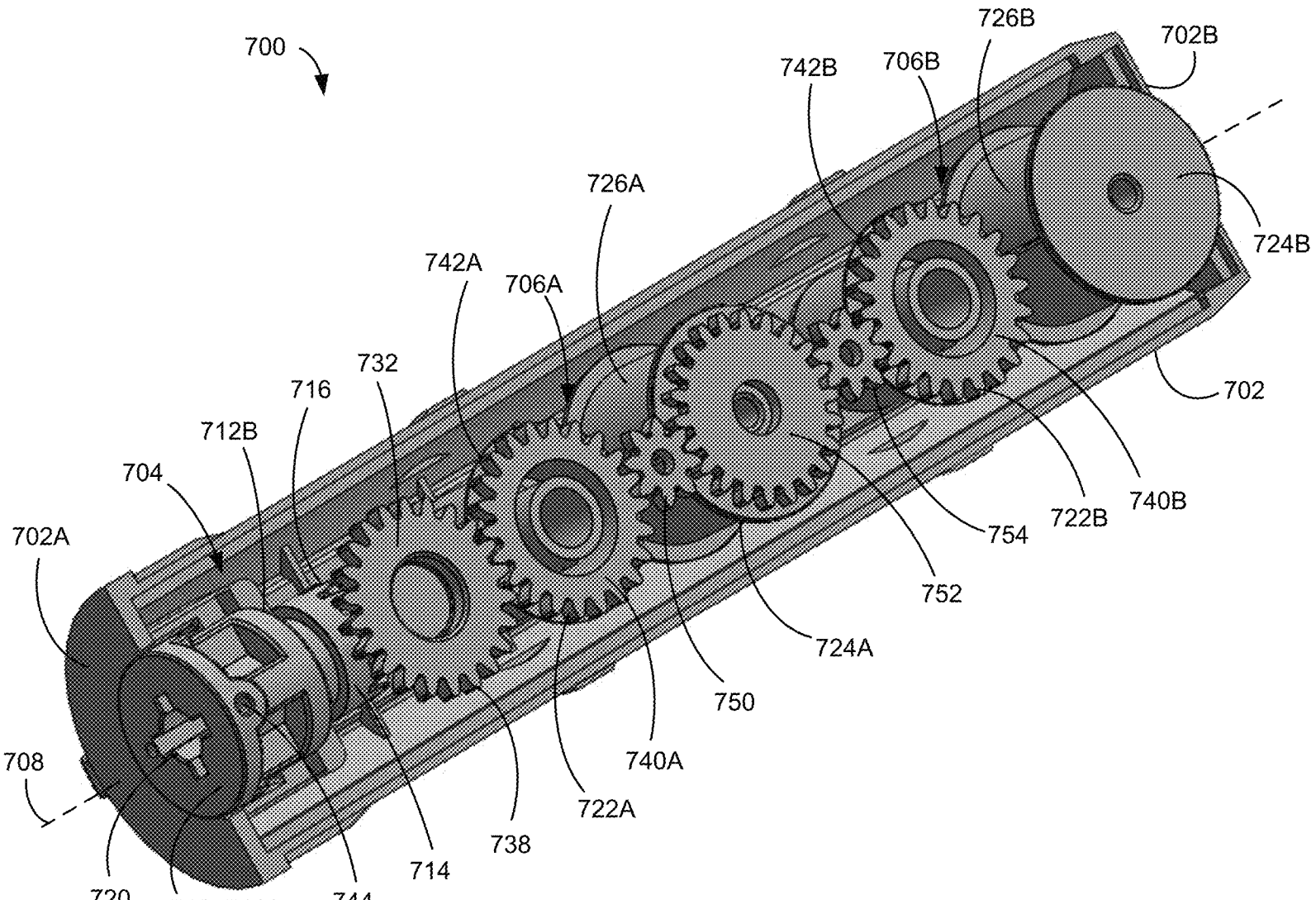
FIG. 15 is a bottom perspective view of the holding assembly shown in FIG. 13 with a portion of the housing removed to illustrate internal components.

FIGS. 13-15 illustrate an exemplary holding assembly, referred to generally as 700, for inhibiting movement of a blind when not being adjusted. Holding assembly 700 may be used in an alternative embodiment of the roller blind assembly 100 to replace clutch assembly 200. As will be described in more detail below, holding assembly 700 may allow a user to raise and/or lower a blind by pulling down or pushing up on the bottom of a blind, thereby eliminating the need for a cord and associated hardware. Typically, a roller blind assembly is secured between a first and a second support bracket (not shown) spaced horizontally apart from the first bracket. The support brackets are generally mounted to a wall or support surface adjacent the window frame and/or door frame.

Figure 16:
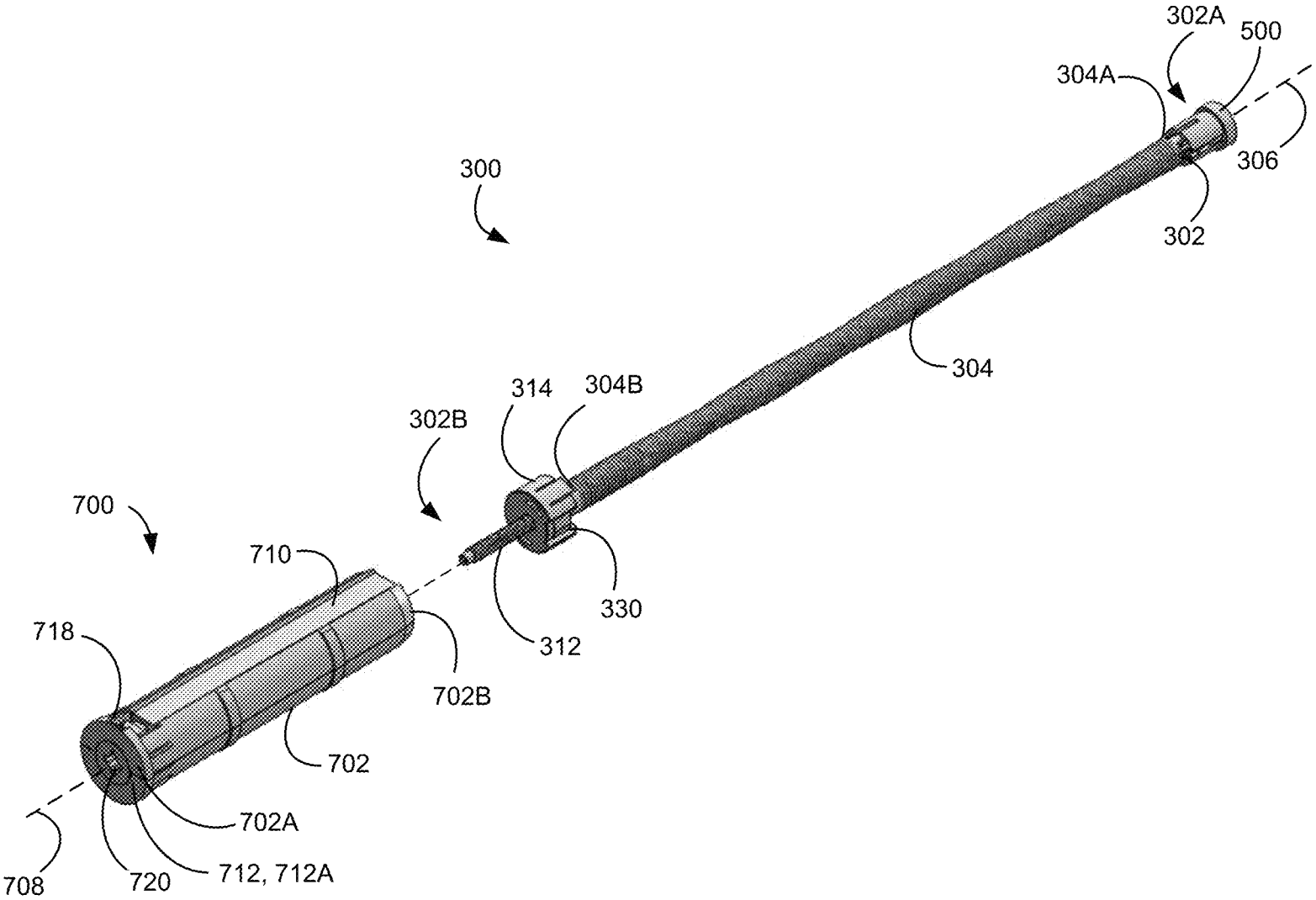
FIG. 16 is a side perspective view of the holding assembly shown in FIG. 13 and a pre-torsioned spring assembly that may be included in a roller blind assembly in accordance with an exemplary embodiment.
Figure 17:
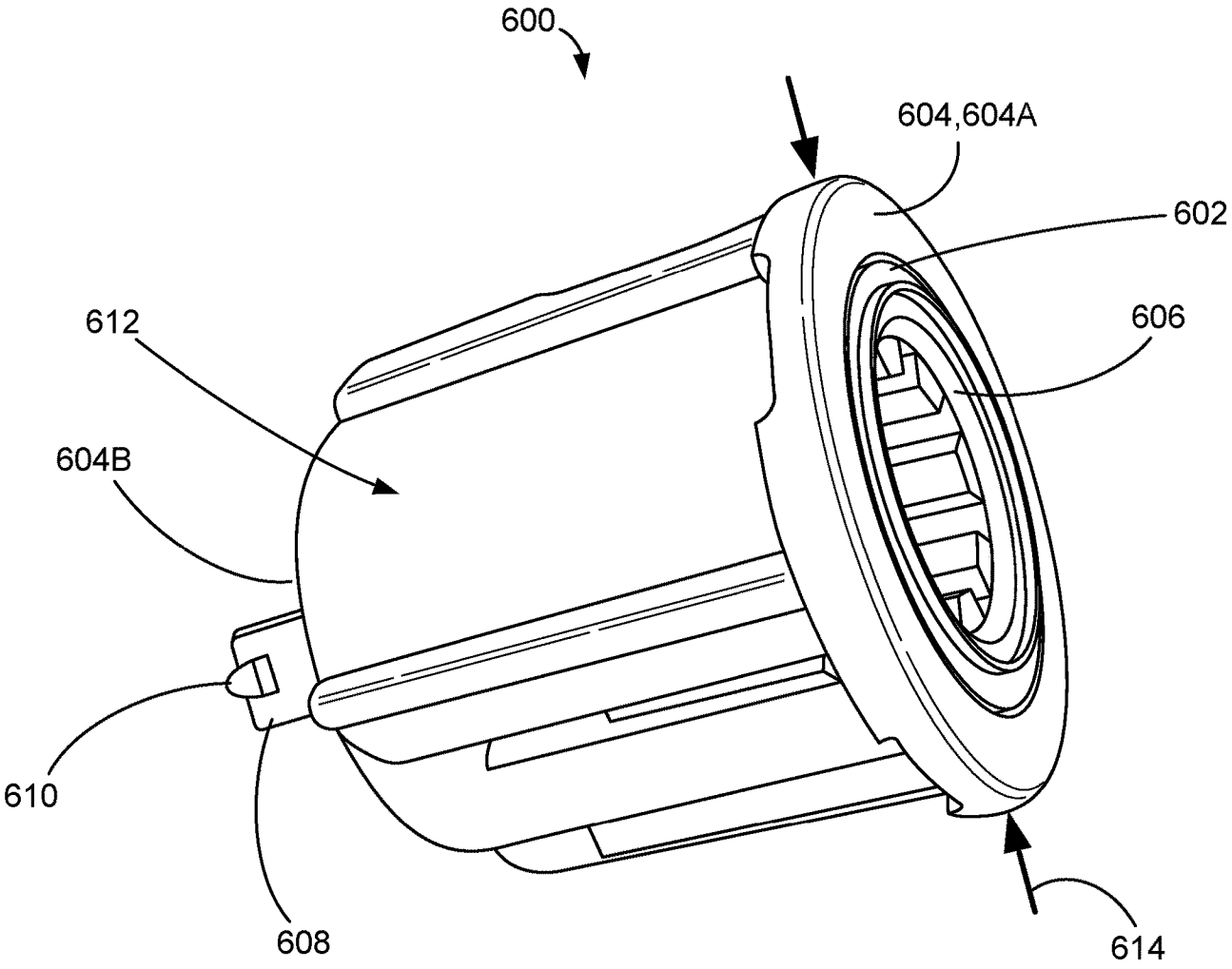
FIG. 17 is side perspective view of an exemplary plug that may be used to secure one end of the pre-torsioned spring assembly of FIG. 16 to a support bracket.

Turning to FIG. 16, a roller blind assembly may comprise the holding assembly 700 and the pre-torsioned spring assembly 300, which are positioned within a blind roller (not shown) at opposite ends thereof when the blind roller assembly is assembled. Unless otherwise noted, the pre-torsioned spring assembly 300 operates as described above with reference to FIG. 1-12. Referring to FIG. 17, in such roller blind assemblies, a plug 600 may be used to secure the first shaft end 302A to one of the first and second support brackets.

With continued reference to FIG. 17, plug 600 comprises a plug body 602 and a plug collar 604 positioned around the plug body 602. The plug collar 604 is rotatable about the plug body 602. The plug collar 604 has a generally cylindrical outer surface that extends from a first end 604A to a second end 604B. The plug body 602 is preferably longer than the plug collar 604, with a portion of the plug body 602 protruding from the second end 604B of the plug collar 604. The protruding portion may include a coupling head 608.

During assembly, the coupling head 608 is positioned within an opening defined in the first shaft end 302A. The opening is not visible in FIG. 16 but may be analogous to opening 322 shown in FIG. 5. This engagement between the coupling head 608 and the opening secures the plug 600 to the spring assembly 300 at the first shaft end 302A. In the illustrated example, the coupling head 608 includes a pair of protrusions 610 extending radially outwardly therefrom (only one of the protrusions 610 is visible in FIG. 17). To secure the connection between the plug 600 and the spring assembly 300 in a predetermined alignment, the protrusions 610 may engage corresponding recesses or apertures defined in the shaft 302 at the first shaft end 302A. The recesses are not visible in FIG. 16 but may be analogous to recesses 310A and 310B shown in FIG. 5.

As with roller blind assembly 100, the roller blind assembly according to this exemplary embodiment may also include a locking collar 500. The locking collar 500 shown in FIG. 16 is analogous to the locking collar 500 described above and illustrated in FIGS. 3-5. With the locking collar 500 positioned around the shaft 302 at the first shaft end 302, the protrusions 610 are retained within the corresponding recesses. Accordingly, the locking collar 500 may inhibit or prevent the protrusions 610 of coupling head 608 from disengaging the corresponding recesses of shaft 302. This may further secure the connection between the plug 600 and the spring assembly 300.

The plug 600 is preferably configured to fit within the cavity of blind roller (e.g. see cavity 404 shown in FIG. 8). Preferably, the external diameter 614 of plug 600 is slightly smaller than the internal diameter of the blind roller. In this way, the plug 600 may fit securely within the cavity of the blind roller. The internal diameter can vary across blind rollers. To account for such variance, a plurality of plugs 600 with different external diameters may be provided.

The plug body 602 has a recess 606 defined in an end thereof (i.e. in the end opposite coupling head 608). The recess 606 receives a protrusion or projection extending from one of the first and second support brackets. In this way, the pre-torsioned spring assembly 300 may be secured to that support bracket via the plug 600. In some cases, when secured to the support bracket, the plug 600 may provide support to the blind roller.

Referring still to FIG. 17, the plug collar 604 has a channel 612 defined in its outer circumferential surface that extends between the first end 604A and the second end 604B. During assembly, both the notch 330 of restraining assembly 314 (FIG. 16) and the channel 612 of plug collar 604 receive a groove of the blind roller (e.g. groove 408 shown in FIG. 8).

As the blind roller rotates, engagement between: i) the groove of the blind roller and the notch 330 of restraining assembly 314, and ii) the groove of the blind roller and the channel 612 of plug collar 604 causes the restraining assembly 314 and the plug collar 604 to rotate in unison with the blind roller 400. The plug collar 604 rotates independently of the plug body 602.

Returning to FIG. 14, an exemplary holding assembly 700 includes a housing 702 positioned within the interior cavity of the blind roller (not shown in FIG. 14), a connector 704 that secures the housing 702 to one of the first and second support brackets (also not shown), and two spool assemblies 706A and 706B located within the housing 702. As illustrated in FIG. 13, the housing 702 is preferably cylindrical. However, alternative housing shapes may be used. The housing 702 extends longitudinally between a first housing end 702A and a second housing end 702B. The housing 702 is rotatable about a housing rotation axis 708. The connector 704 secures the housing 702 to support bracket at the first housing end 702A.

The housing 702 locates within the cavity of the blind roller. Preferably, the housing 702 has an external diameter 703 that is slightly smaller than the internal diameter of the blind roller. In this way, the housing 702 may fit securely within the cavity of blind roller.

The housing 702 engages the interior cavity of the blind roller such that the housing 702 rotates in unison with the blind roller. As shown in FIG. 13, the housing 702 has a longitudinally extending slot 710 defined in its outer circumferential surface. During assembly, the slot 710 receives a corresponding groove of the blind roller (see e.g. groove 408 shown in FIG. 8). When the groove is received in the slot 710, the housing 702 and the blind roller may rotate in unison about the housing rotation axis 708.

Referring again to FIG. 14, the connector 704 includes a generally cylindrical connector body 712 that extends longitudinally between a first end 712A located at the first housing end 702A and a second end 712B located within the housing 702, and a connector gear 714 that extends from the second end 712B of the connector body 712 toward the second housing end 702B. The connector gear 714 has a plurality of preferably conical teeth 716 disposed around its outer circumferential surface.

With reference to FIGS. 13 and 15, the connector body 712 has a recess 720 defined in the first end 712A. The recess 720 receives a protrusion or projection (not shown) extending from one of the first and second support brackets to secure the holding assembly 700 to that support bracket. Preferably, as illustrated in FIG. 13, the first end 712A of the connector 712 is substantially flush with the first housing end 702A. In this way, the recess 720 is accessible to engage the support bracket. The connector 704 is constrained axially with the housing 702; however, the housing 702 is rotatable about the housing axis 708 independently of the connector 704. In this way, when the connector 704 is secured to the support bracket, rotation of the blind roller concurrently rotates the housing 702 about the housing rotation axis 708, but not the connector 704 (i.e. the housing 702 rotates around the generally cylindrical connector body 712).

Referring again to FIG. 14, the two spool assemblies 706A and 706B are referred to generally as first spool assembly 706A and second spool assembly 706B. Corresponding parts in the first and second spool assemblies 706A and 706B have been assigned the same part numbers which end in "A" when belonging to the first spool assembly 706A and "B" when belonging to the second spool assembly 706B.

Referring to FIGS. 14 and 15, the first spool assembly 706A comprises a first spool 722A and a second spool 724A rotatably mounted to the housing 702, and a resilient band 726A. The resilient band 726A extends between a first band end secured to the first spool 722A and a second band end secured to the second spool 724A. In this way, wrapping the resilient band 726A around one of the first and second spools 722A and 724A concurrently unwraps the resilient band 726A from the other of the first and second spools 722A and 724A. The first and second band ends are not visible in FIGS. 14 and 15. The resilient band 726A is preferably made from spring steel, but those skilled in the art will appreciate that the resilient band 726A could also be made from a copper alloy, aluminum, or other suitable metals and metal alloys.

As will be described in greater detail below, the resilient band 726A exerts a resistive torque on the connector 704 that inhibits rotation of the housing 702 relative to the connector 704. Since the housing 702 is rotationally engaged with the blind roller, the holding assembly 700 exerts a resisting torque on the blind roller that inhibits rotation of the blind roller relative to the connector 704 when the connector 704 is secured to the support bracket. The holding assembly 700 may hold the blind roller stationary (i.e. in a static state) until a net torque that is greater than the resisting torque is applied to the blind roller. Thus, when the net torque applied to the blind roller (e.g. the difference between torque applied by spring assembly 300 and torque applied by the weight of hanging blind material) is below the resisting torque, the holding assembly 700 may inhibit or prevent rotation of the blind roller.

The resistive torque that the resilient band 726A exerts on the connector 704 remains generally constant regardless of the extent that the resilient band 726A is wrapped around each of the first and second spools 722A and 724A at a given time. Thus, the resistive torque when the resilient band 726A is completely wrapped around the first spool 722A is generally the same as when the resilient band 726A is completely wrapped around the second spool 724A. In this way, when the connector 704 is secured to the support bracket, the resisting torque applied to the blind roller via the holding assembly 700 remains generally constant as the blind roller rotates.

The first and second spools 722A and 724A can be mounted to the housing 702 in a number of suitable ways. For example, a pin, a tack or the like, may be used to mount the first and second spools to the housing 702. When mounted to the housing 702, the first spool 722A is rotatable about a first spool axis 728A while the second spool 724A is rotatable about a second spool axis 730A.

With continued reference to FIGS. 14 and 15, holding assembly 700 also includes a transfer gear 732 rotatably mounted to the housing 702. The transfer gear 732 can be mounted to the housing 702 in a number of suitable ways. For example, a pin, a tack or the like, may be used to mount the transfer gear 732 to the housing 702. When mounted to the housing 702, the transfer gear 732 is rotatable about a transfer gear axis 734. As shown in FIG. 14, the transfer gear axis 734 is substantially orthogonal to the housing rotation axis 708. The transfer gear axis 734 is generally parallel with the first spool axis 728A and the second spool axis 730A.

Referring to FIG. 14, the transfer gear 732 has a plurality of preferably conical teeth 736 that extend outwardly from a face thereof. The teeth 736 of the transfer gear 732 are intermeshed with the teeth 716 of the connector gear 714. As a result, when the connector 704 is secured to the support bracket, rotation of the housing 702 about the connector gear 714 causes the teeth of the transfer gear 732 to engage the teeth of the connector gear 714. This in turn causes the transfer gear 732 to rotate about the transfer gear axis 734 as the housing 702 is rotating.

The transfer gear 732 is drivingly engaged with the first spool 722A of the first spool assembly 706A such that rotating the transfer gear 732 about the transfer gear axis 734 causes the first spool 722A to rotate about the first spool axis 728A. Referring to FIG. 15, the transfer gear 732 has a plurality of teeth 738 disposed around its outer circumferential surface. The first spool 722A has a first spool gear 740A located at one of its ends. The first spool gear 740A has a plurality of teeth 742A disposed around its outer circumferential surface. The teeth 738 of the transfer gear 732 are intermeshed with the teeth 742A of the first spool gear 740A such that rotation of the transfer gear 732 about the transfer gear axis 734 causes the first spool 722A to rotate about the first spool axis 728A.

Referring to FIG. 14, rotation of the housing 702 about the housing axis 708 in a direction $D_1$ relative to the connector 704 causes the transfer gear 732 to rotate in a direction $D_3$ about the transfer gear axis 734, which, in turn, causes the first spool 722A to rotate in a direction $D_5$ about the first spool axis 728A. As the first spool 722 rotates in direction $D_5$, the resilient band 726A unwraps from the second spool 724A and wraps around the first spool 722A. Conversely, rotation of the housing 702 about the housing axis 708 in a direction $D_2$ relative to the connector 704 causes the transfer gear 732 to rotate in a direction $D_4$ about the transfer gear axis 734, which, in turn, causes the first spool 722A to rotate in a direction $D_6$ about the first spool axis 728A. As the first spool 722A rotates in direction $D_6$, the resilient band 726A unwraps from the first spool 722A and wraps around the second spool 724A.

The second spool 724A rotates about the second spool axis 730A in a direction opposite that of the first spool 722A in order to allow the resilient band 726A to either wrap or unwrap therefrom (i.e. the second spool 724A rotates in a direction $D_7$ when the first spool 722A is rotating in direction $D_5$ and the second spool 724A rotates in a direction $D_8$ when resilient first spool 722A is rotating in direction $D_6$.

Referring to FIG. 15, the first and second spool assemblies 706A and 706B are connected in series. The first spool gear 740A of the first spool assembly 706A drives the first spool gear 740B of the second spool assembly 706B through three intermediate gears: 750, 752 and 754. This configuration allows the first spool 722A of the first spool assembly 706A to rotate in the same direction as the first spool 722B of second spool assembly 706B. Using multiple spool assemblies (such as first and second spool assemblies 706A and 706B) allows the holding assembly 700 to exert a greater resisting torque on the blind roll to inhibit rotation of the blind roller relative to the connector 704 when the connector is secured to the support bracket. Those skilled in the art will appreciate that the movement assembly may utilize only one spool assembly or any suitable number of additional spool assemblies can be added in series to increase the resisting torque that the holding assembly can exert on the blind roller.

In the illustrated example shown in FIGS. 13-16, the holding assembly 700 also includes a locking pin 718 that may be used remove slack from the resilient bands 726A and 726B at any point prior to installation. When the resilient bands 726A and 726B are not taut between respective first and second spools 722A, 724A and 722B, 724B prior to installation, the resistive torque applied by the holding assembly 700 may not be constant during operation of the roller blind assembly. The locking pin 718 is actuable between an engaged position and a disengaged position. In the illustrated example, the locking pin 718 is actuated between these positions by pushing the locking pin 718 into an insertion hole 744 (shown in FIG. 15) in the outer circumferential surface of the connector body 712, or pulling the locking pin out of the insertion hole.

As shown in FIG. 13, in the engaged position, the locking pin 718 substantially prevents relative rotation between the housing 702 and connector 704. The locking pin 718 prevents this relative rotation by projecting from the connector 704 and out of the housing 702 through an aperture 746 defined through its outer circumferential surface. As a result, the locking pin 718 obstructs rotation of the housing 702 around the connector 704. In the disengaged position, the locking pin is removed (i.e. pulled out) of the insertion hole 744. In such position, the housing 702 is able to rotate relative to the connector 704 without obstruction from the locking pin 718.

For example, to remove the slack from the resilient bands 726A and 726B, with one hand grasping the housing 702, the connector gear 714 is rotated with the other hand via the recess 720. A tool, such as a screwdriver, may be engaged with the recess 720 to simplify turning of the connector gear 714. As described above, turning the connector gear 714 concurrently turns the first spools 722A and 722B. The connector gear 714 is turned until the slack is removed from resilient bands 726A and 726B. This point may be observed when an increase in resistance occurs when turning the connector gear 714. Once the slack has been removed, the locking pin 718 is moved to the engaged position (i.e. inserted in the insertion hole 744). In such position, the resilient bands 726A and 726B remain taut because the connector gear 714 is unable to rotate relative to the housing 702 due to the locking pin 718. In some cases, the holding assembly 800 may be transported with an elastic band or tape wrapped around to the housing 702 to cover the locking pin 718. This may prevent the locking pin from moving inadvertently to the disengaged position (i.e. popping out) during shipping. The elastic band and/or the tape may be removed after the connector 704 is secured to the support bracket.

After the connector 704 is secured to the support bracket (e.g. via recess 720) during installation, the locking pin 718 is moved to the disengaged position (i.e. pulled out of the insertion hole 744) to permit the housing 702 to rotate relative to the connector 704.

Roller blind assemblies that include a pre-torsioned spring assembly 300 and a holding assembly 700 may have one or more advantages. For example, roller blind assemblies that include a holding assembly 700 and a pre-torsioned spring assembly 300 do not require the use of a cord or chain to raise and lower the blind. Such roller blind assemblies are commonly used when the blind is heavy, e.g. a 'black-out' blind. To raise and lower the blind, a user can apply force directly to the blind. For example, by applying an upward force to the bottom or other part of the hanging blind, the user may raise the blind.

Furthermore, as described above, the varying torque applied by the pre-torsioned spring assembly 300 preferably allows the roller blind assembly 100 to hold a blind in a static state (in which the blind does not move up or down) at any position between the fully raised and fully lowered positions. In such a static state, the torque applied to the blind roller by the pre-torsioned spring assembly 300 (tending to raise the blind) may be substantially equal to the torque applied to the blind roller from the weight of the blind material suspended from a position offset from the axis of the blind roller (tending to lower the blind). Provided the net torque applied to the blind roller (e.g. the difference between torque applied by spring assembly 300 and torque applied by the weight of hanging blind material) is below the resisting torque applied by the holding assembly, the holding assembly 700 will inhibit or prevent rotation of the blind roller. Only once a net torque above the resisting torque is applied to the blind roller will the holding assembly 700 permit rotation of the blind roller. Thus, to raise or lower the blind, a user only needs to apply a force to the blind (preferably at the bottom edge or bottom rail of the blind) sufficient to overcome the resisting torque of the holding assembly 700. Accordingly, as with roller blind assembly 100, such roller blind assemblies may also be characterized as a "lift-assisted" or "light lift" roll blind assembly.

In some embodiments, an installer may be provided with a kit that includes a blind roller, a holding assembly 700, at least two pre-torsioned spring assemblies 300 and optionally a plug 600. In such embodiments, assembly and/or installation may be simplified by providing two or more pre-torsioned spring assemblies that each have different preset torsions. As described above, this may allow an assembler and/or an installer to select a pre-torsioned spring assembly 300 that has the appropriate preset torsion for a specific installation. When the roller blind assembly is assembled, the holding assembly 700, the spring 304, the restraining assembly 314, the blind roller 400 and may be substantially co-axial with the central axis 306 of shaft 302.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A roller blind assembly securable between a first support bracket and a second support bracket horizontally spaced apart from the first support bracket, the roller blind assembly comprising:

I) a blind roller comprising a cylindrical wall extending from a first roller end to a second roller end, the wall defining an interior cavity extending between the first and second roller ends;

II) a holding assembly comprising:

a) a housing positioned within the interior cavity of the blind roller, wherein the housing extends longitudinally between a first housing end and a second housing end, wherein the housing is configured to engage the interior cavity of the blind roller such that the housing rotates in unison with the blind roller;

b) a connector configured to secure the housing, at the first housing end, to the first support bracket, wherein, when the connector is secured to the first support bracket, the housing rotates independently of the connector; and c) at least one spool assembly located within the housing, the at least one spool assembly comprising:
a first spool and a second spool rotatably mounted to the housing; and
a resilient band extending between a first band end and a second band end, wherein the first band end is secured to the first spool and the second band end is secured to the second spool, wherein wrapping the resilient band around one of the first and second spools concurrently unwraps the resilient band from the other of the first and second spools;

wherein, when the connector is secured to the first support bracket, the holding assembly is configured to exert a resisting torque on the blind roller to inhibit rotation of the blind roller relative to the connector;

III) a pre-torsioned spring assembly comprising:
i) a shaft extending from a first shaft end to a second shaft end, the shaft having a threaded section proximate the second shaft end;
ii) a plug configured to secure the first shaft end to the second support bracket;
iii) a restraining member defining a threaded internal passage extending axially therethrough, wherein the threaded section of the shaft is received within the internal passage and threadably engages therewith, wherein the restraining member is configured for movement along the threaded section of the shaft;
iv) a restraining body removably coupled to the restraining member, wherein the restraining body is configured to engage the interior cavity of the blind roller such that the restraining member and the restraining body rotate in unison with the blind roller; and
v) a spring extending around the shaft, the spring having a first spring end coupled to the first shaft end, and a second spring end coupled to the restraining body, wherein the spring has a preset torsion, wherein, when the restraining body is coupled to the restraining member, the restraining body and the restraining member cooperate to maintain the preset torsion;

wherein the pre-torsioned spring assembly is positioned in the interior cavity of the blind roller, wherein the pre-torsioned spring assembly exerts a torque on the blind roller proportional to the preset torsion of the spring to assist rotation of the blind roller.

2. The roller blind assembly of claim 1, wherein rotation of the blind roller in a first direction relative to the shaft decreases a torsion in the spring, thereby decreasing the torque that the pre-torsioned spring assembly exerts on the blind roller, and wherein rotation of the blind roller in a second direction relative to the shaft increases the torsion in the spring, thereby increasing the torque that the pre-torsioned spring assembly exerts on the blind roller.

3. The roller blind assembly of claim 1, wherein the resisting torque exerted on the blind roller by the holding assembly remains constant as the blind roller rotates.

4. The roller blind assembly of claim 1, wherein the wall of the blind roller has a longitudinally extending groove that projects inwardly into the interior cavity, and wherein the restraining body comprises a cap and a sleeve portion removably received within the cap, and wherein the cap is configured to engage the groove of the blind roller.

5. The roller blind assembly of claim 1, wherein the wall of the blind roller has a longitudinally extending groove that projects inwardly into the interior cavity, and wherein the plug comprises a plug body securable to the second support bracket and a generally cylindrical plug collar positioned around the plug body, wherein the plug collar is configured to engage the groove of the blind roller, and wherein, when the plug body is secured to the second support bracket, the plug collar rotates independently of the plug body.

6. The roller blind assembly of claim 5, wherein the plug collar extends from a first end to a second end, wherein a portion of the plug body protrudes from the second end of the plug collar, and wherein the portion comprises a coupling head.

7. The roller blind assembly of claim 6, wherein the coupling head is positionable in an opening defined in the first shaft end, and wherein the coupling head has at least one radially extending protrusion and the first shaft end has at least one complementary recess for receiving the at least one protrusion.

8. The roller blind assembly of claim 7, further comprising a locking collar positionable around the shaft at the first shaft end when the at least one radially extending protrusion is received in the at least one complementary recess.

9. The roller blind assembly of claim 5, wherein the first shaft end is positionable in an opening defined in the second plug end, and wherein the plug body includes at least one radially inwardly extending protrusion and the first shaft end includes at least one complementary recess for receiving the at least one protrusion.

10. The roller blind assembly of claim 1, wherein the wall of the blind roller has a longitudinally extending groove that projects inwardly into the interior cavity, wherein the housing is configured to engage the groove, and wherein the housing is generally cylindrical.

11. The roller blind assembly of claim 1, wherein the restraining member comprises a restraining nut, and wherein the restraining body comprises a restraining nut engagement recess facing the second shaft end and a clip that retains the restraining nut in the restraining nut engagement recess.

12. The roller blind assembly of claim 1, wherein the housing defines a housing rotation axis, wherein, when the connector is secured to the first support bracket, rotation of the housing about the housing rotation axis rotates the first spool about a first spool axis, and wherein the first spool axis is substantially orthogonal to the housing rotation axis.

13. The roller blind assembly of claim 12, wherein the connector comprises:
a generally cylindrical connector body extending longitudinally between a first end located at the first housing end and a second end located within the housing; and
a connector gear extending from the second end of the connector body.

14. The roller blind assembly of claim 13, wherein the first end of the connector body is substantially flush with the first housing end.

15. The roller blind assembly of claim 13, wherein the holding assembly further comprises a transfer gear rotatably mounted to the housing, wherein the transfer gear engages the connector gear, wherein, when the connector is secured to the first support bracket, rotation of the housing about the housing rotation axis causes the connector gear to rotate the transfer gear about a transfer gear axis, wherein the transfer gear axis is substantially orthogonal to the housing rotation axis, wherein the transfer gear is configured to rotate the first spool of the at least one spool assembly.

16. The roller blind assembly of claim 15, wherein the first spool has a first spool gear located at an end thereof, and wherein the transfer gear engages the first spool gear to drive the first spool gear, thereby rotating the first spool.

17. The roller blind assembly of claim 13, wherein rotation of the first spool in a third direction about the first spool axis wraps the resilient band around the first spool, and wherein rotation of the first spool about the first spool axis in a fourth direction, opposite the third direction, unwraps the resilient band from the first spool.

18. The roller blind assembly of claim 1, wherein the holding assembly comprises two spool assemblies connected in series.

19. The roller blind assembly of claim 18, wherein one of the two spool assemblies is drivingly engaged to the other of the two spool assemblies through at least one intermediate gear.

20. The roller blind assembly of claim 19, wherein the first spool gear of one of the two spool assemblies is drivingly engaged to the first spool gear of the other of the two spool assemblies through three intermediate gears.

21. The roller blind assembly of claim 18, wherein, when the connector is secured to the first support bracket, rotation of the housing about the housing rotation axis results in the rotation of the first spool gears of each spool assembly in the same direction.

22. The roller blind assembly of claim 1, wherein the holding assembly further comprises a locking pin actuable between an engaged position and a disengaged position, wherein, in the engaged position, the locking pin inhibits relative rotation between the connector and the housing, and wherein, in the disengaged position, the housing rotates independently of the connector.

23. The roller blind assembly of claim 22, wherein the locking pin is removed from the holding assembly in the disengaged position.

24. A kit for a roller blind assembly that is securable between a first support bracket and a second support bracket horizontally spaced apart from the first support bracket, the kit comprising:

I) a blind roller comprising a cylindrical wall extending from a first roller end to a second roller end, the wall defining an interior cavity extending from the first roller end;

II) a holding assembly comprising:

a) a housing positioned within the interior cavity of the blind roller, wherein the housing extends longitudinally between a first housing end and a second housing end, wherein the housing is configured to engage the interior cavity of the blind roller such that the housing rotates in unison with the blind roller;

b) a connector configured to secure the housing, at the first housing end, to the first support bracket, wherein, when the connector is secured to the first support bracket, the housing rotates independently of the connector; and c) at least one spool assembly located within the housing, the at least one spool assembly comprising:

a first spool and a second spool rotatably mounted to the housing; and a resilient band extending between a first band end and a second band end, wherein the first band end is secured to the first spool and the second band end is secured to the second spool, wherein wrapping the resilient band around one of the first and second spools concurrently unwraps the resilient band from the other of the first and second spools;

wherein, when the connector is secured to the first support bracket, the holding assembly is configured to exert a resisting torque on the blind roller to inhibit rotation of the blind roller relative to the connector;

III) a plurality of pre-torsioned spring assemblies, wherein each pre-torsioned spring assembly in the plurality of pre-torsioned spring assemblies comprises:

i) a shaft extending from a first shaft end to a second shaft end;

ii) a plug configured to secure the first shaft end to the second support bracket; and iii) a spring extending around the shaft, the spring having a first spring end coupled proximate to the first shaft end, and a second spring end operatively coupled proximate to the second shaft end, wherein the spring has a preset torsion;

wherein a first pre-torsioned spring assembly in the plurality of pre-torsioned spring assemblies has a different spring preset torsion than a second pre-torsioned spring assembly in the plurality of pre-torsioned spring assemblies, wherein a selected one of the plurality of pre-torsioned spring assemblies is positionable in the interior cavity of the blind roller, and wherein, when the selected pre-torsioned spring assembly is positioned in the interior cavity of the blind roller, that pre-torsioned spring assembly exerts a torque on the blind roller proportional to the preset torsion of the spring.

25. The kit of claim 24, wherein the shaft of each pre-torsioned spring assembly in the plurality of pre-torsioned spring assemblies has a threaded section proximate the second shaft end, wherein each pre-torsioned spring assembly in the plurality of pre-torsioned spring assemblies further comprises:

a restraining member defining a threaded internal passage extending axially therethrough, wherein the threaded section of the shaft is received within the internal passage and threadably engages therewith, wherein the restraining member is configured for movement along the threaded section of the shaft; and a restraining body removably coupled to the restraining member, wherein the restraining body is configured to engage the interior cavity of the blind roller such that the restraining member and the restraining body rotate in unison with the blind roller;

wherein the second spring end is coupled to the restraining body, and wherein, when the restraining body is coupled to the restraining member, the restraining body and the restraining member cooperate to maintain the preset torsion.

* * * * *